US009988840B2

(12) United States Patent
Veatch et al.

(10) Patent No.: US 9,988,840 B2
(45) Date of Patent: Jun. 5, 2018

(54) MODULAR, ROLL-DOWN AIRFLOW CONTROL APPARATUS

(71) Applicant: Kool Pak LLC, Lake Oswego, OR (US)

(72) Inventors: Dennis Veatch, Portland, OR (US); Allen Ross Lee, Lake Oswego, OR (US)

(73) Assignee: Kool Pak LLC, Lake Oswego, OR (US)

( * ) Notice: Subject to any disclaimer, the term of this patent is extended or adjusted under 35 U.S.C. 154(b) by 0 days. days.

(21) Appl. No.: 14/284,703

(22) Filed: May 22, 2014

(65) Prior Publication Data

US 2014/0352898 A1 Dec. 4, 2014

Related U.S. Application Data

(60) Provisional application No. 61/830,501, filed on Jun. 3, 2013.

(51) Int. Cl.

| | |
|---|---|
| ***E06B 9/60*** | (2006.01) |
| ***E06B 9/62*** | (2006.01) |
| ***E06B 9/17*** | (2006.01) |
| *E06B 7/22* | (2006.01) |
| *E06B 9/13* | (2006.01) |

(52) U.S. Cl.

CPC ..... *E06B 9/60* (2013.01); *E06B 9/17* (2013.01); *E06B 9/62* (2013.01); *E06B 7/22* (2013.01); *E06B 9/13* (2013.01); *E06B 2009/135* (2013.01); *Y10T 29/49947* (2015.01)

(58) Field of Classification Search

CPC ... E06B 9/17; E06B 9/174; E06B 9/60; E06B 9/62; E06B 9/582; E06B 2009/445

USPC ..... 160/313, 301, 290.1

See application file for complete search history.

(56) References Cited

U.S. PATENT DOCUMENTS

| | | | | |
|---|---|---|---|---|
| 203,414 A | | 5/1878 | Buckley et al. | |
| 1,712,594 A | * | 5/1929 | Valentine | E06B 9/54 160/313 |
| 2,564,770 A | * | 8/1951 | Spencer | E06B 9/58 160/271 |

(Continued)

FOREIGN PATENT DOCUMENTS

| | | |
|---|---|---|
| GB | 167390 | 8/1921 |

*Primary Examiner* — Blair M Johnson

(74) *Attorney, Agent, or Firm* — Paul B. Heynssens; Ater Wynne LLP

(57) ABSTRACT

A flexible yet durable roll-down curtain is normally stored in a rolled condition, and is unrolled during use. The curtain includes plural, vertically spaced apart rods extending through a width of the curtain. When rolled, the curtain wraps around an elongate, spring-loaded mandrel assembly. The mandrel assembly couples with a pair of mounting brackets mounted at opposing sidewalls of a temperature-controlled compartment. A pair of locking brackets disposed directly opposite one another at opposing sidewalls engage opposing ends of a rod extending through the curtain, to retain the curtain in a deployed position. A flexible side seal provides a sealing engagement vertically along each side edge of the curtain. When deployed, the curtain extends from ceiling to floor, and from sidewall to sidewall, forming a barrier against uncontrolled air movement from a space on either side of the curtain to a space on an opposing side of the curtain.

13 Claims, 14 Drawing Sheets

(56) References Cited

U.S. PATENT DOCUMENTS

| | | | | | |
|---|---|---|---|---|---|
| 4,194,550 | A * | 3/1980 | Hopper | A47H 23/06 | 160/107 |
| 4,519,434 | A | 5/1985 | Forquer | | |
| 4,658,877 | A | 4/1987 | Quinn | | |
| 5,450,890 | A * | 9/1995 | Pinkalla | E06B 3/80 | 160/121.1 |
| 5,601,134 | A | 2/1997 | Pinkalla et al. | | |
| 6,406,232 | B1 * | 6/2002 | Snitker | B60J 5/08 | 160/290.1 |
| 8,997,825 | B1 * | 4/2015 | Caldwell | E06B 9/15 | 160/133 |
| 2002/0139493 | A1 * | 10/2002 | Brown | B65D 90/021 | 160/313 |
| 2013/0025803 | A1 * | 1/2013 | Eiterman | G01M 99/008 | 160/305 |
| 2014/0352898 | A1 * | 12/2014 | Veatch | E06B 9/13 | 160/323.1 |

* cited by examiner

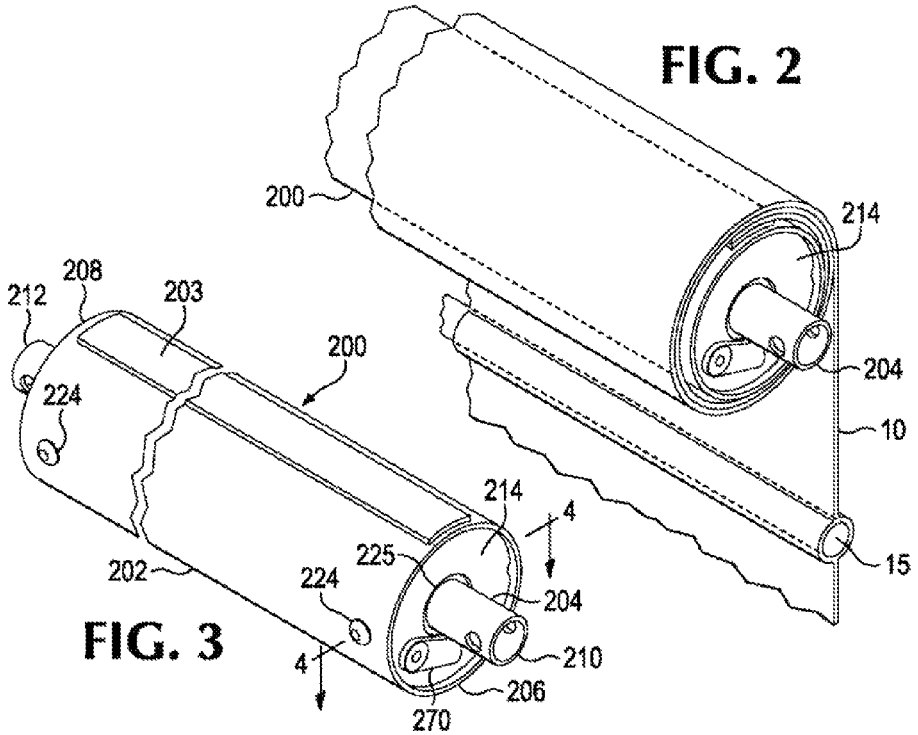
FIG. 2
FIG. 3
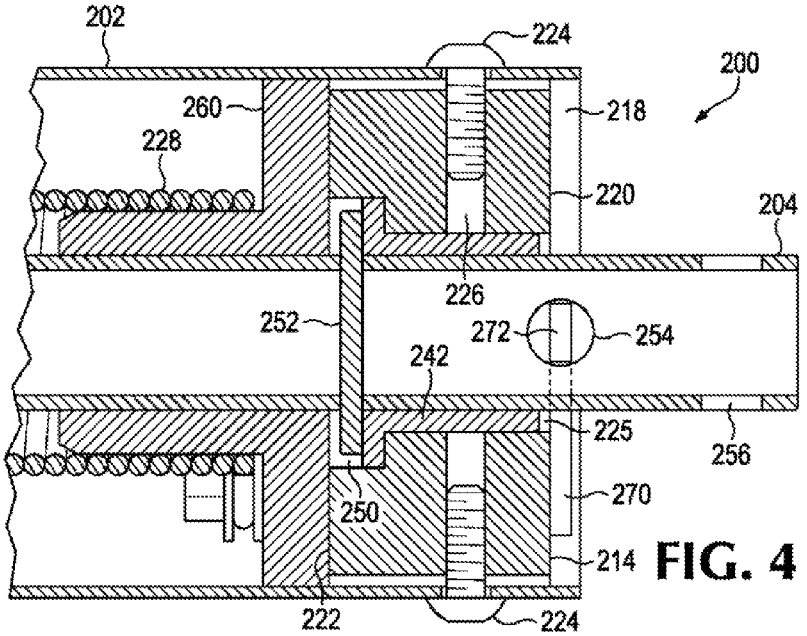
FIG. 4

MODULAR, ROLL-DOWN AIRFLOW CONTROL APPARATUS

FIELD OF THE INVENTION

The invention relates generally to the field of separator devices for restricting airflow between adjacent spaces. More particularly, the invention relates to a modular, roll-down curtain-like device suitable to restrict airflow in or out of a temperature-controlled space such as a portion of a refrigerated cargo compartment of a vehicle.

BACKGROUND OF THE INVENTION

Refrigerated goods are routinely shipped from manufacturers to distribution centers, and from distribution centers to retail outlets, in trucks, train cars and other transport vehicles. When loading and unloading refrigerated goods, refrigerated air easily escapes through the large doors of a refrigerated compartment, and warmer environmental air likewise enters. If the temperature of the goods exceeds a regulatory upper limit, and the frozen goods partially or completely thaw, the goods can be rendered unsellable and must be wasted. To avoid warming of refrigerated goods, a truck engine may need to remain running to power a continuously or repeatedly operating refrigerator unit, consuming fuel, raising the cost of shipping, and producing a large volume of exhaust even when the truck is not being driven.

Various devices are known and used in the shipping industry to control the amount of thermal variation in refrigerated compartments during loading and unloading operations. Bulkheads are relatively large and rigid structural members that can be disposed and arranged to span an opening to a refrigerated compartment, to limit an amount of airflow into or out of the compartment. Bulkheads can be composed of a thermally-insulating material such as expanded polystyrene foam or another material.

However, nearly all bulkheads share certain undesirable features. Firstly, bulkheads are large and unwieldy, making them difficult to constantly remove and replace each time goods are withdrawn from or placed into the refrigerated compartment. This same characteristic means that they consume a large amount of space when stored.

Secondly, the same relatively lightweight materials typically used to provide a bulkhead's thermal insulating properties and rigidity, are also substantially brittle and subject to damage due to repeated handling during use. Therefore, bulkheads must be replaced periodically, sometimes frequently, adding to their total cost of use and directing large units of relatively non-biodegrading materials to landfills.

Thirdly, because bulkheads are typically formed as individual structural units, and are not affixed to the structure of a compartment, bulkheads clutter a loading dock area when removed from a truck interior. During loading and unloading operations, the displaced bulkheads increase the risk of damage to the bulk heads, damage to products, and injury to workers, and affect productivity, as workers must attempt to avoid the bulkheads while carrying loads of products.

Another device used to control airflow into and out of a refrigerated shipping compartment is a curtain composed of sequentially overlapping, vertically-hanging plastic slats. Users can walk through the curtain by pushing adjacent slats outwardly from each other, and the slats then fall back into place once the person has passed through the curtain. Because of the large numbers of gaps between the slats, substantial quantities of air can pass through the curtain relatively unimpeded, particularly when air on one side of the curtain is pressurized or moving, as is common during loading and unloading due to a refrigerated unit and fan activating to maintain a temperature within the refrigerated compartment below a prescribed threshold for maintaining product quality. Additionally, in order to properly function, the individual slats typically do not contact a flooring surface, leaving a gap that colder air can readily transit through and escape from the refrigerated compartment.

Roll-down curtain devices that can be mounted within a refrigerated shipping compartment and rolled up and down during use are not unknown in the industry. However, the designs of current roll-down curtain devices induce one or more of several problems that complicate their installation or use, or limit their utility in one or more relevant ways.

First, most roll-down curtain devices are unitary, requiring that the entire unit be lifted into position and fastened to walls or a ceiling of a freight compartment of a truck, for example. The weight and bulk of such devices complicates the installation process, requiring two or more people; at least one to hold the device in position, and the other to attach fasteners between the device and the truck walls or ceiling. This process likewise increases the risk of stress-related injuries (e.g., twists, sprains, strains, etc.).

Secondly, many such devices include a spring-loaded latching device that locks the curtain in position due to a centrifugal action of the rotating curtain, and releases the curtain in response to contra-rotation of the curtain when pulled by a user, in the commonly-known manner of retraction and recovery of a window shade. Unfortunately, unlike a window shade, the weight of a curtain can cause spontaneous contra-rotation in response to bouncing and shaking of a truck during transit, allowing the curtain to unintentionally and uncontrollably retract, possibly damaging the curtain and defeating the purpose of deploying the curtain.

Thirdly, roll-down curtain devices that require some type of locking or latching feature between the deployed curtain and the floor of a refrigerated compartment—a hook for example—are subject to damage if struck with sufficient force by a person or a moving object, such as a forklift or shifting cargo. Once damaged, the curtain may no longer function properly, and must be repaired or replaced, which in turn can take the truck out of service for a period of time and affect productivity.

What is needed is a device that remedies some or all of the deficiencies discussed above and others observed in the prior art devices.

BRIEF DESCRIPTION OF THE DRAWINGS

FIG. 2 is an isometric view depicting an end of a mandrel assembly with a thermal curtain wound as during stowage, according to an embodiment of the invention.

FIG. 3 is an isometric view of the mandrel assembly of FIG. 2, but omitting the thermal curtain.

FIG. 4 is a sectional view of the mandrel assembly of FIG. 3 taken along the line indicated as 4-4.

DETAILED DESCRIPTION OF THE PREFERRED EMBODIMENTS

Figure 1:
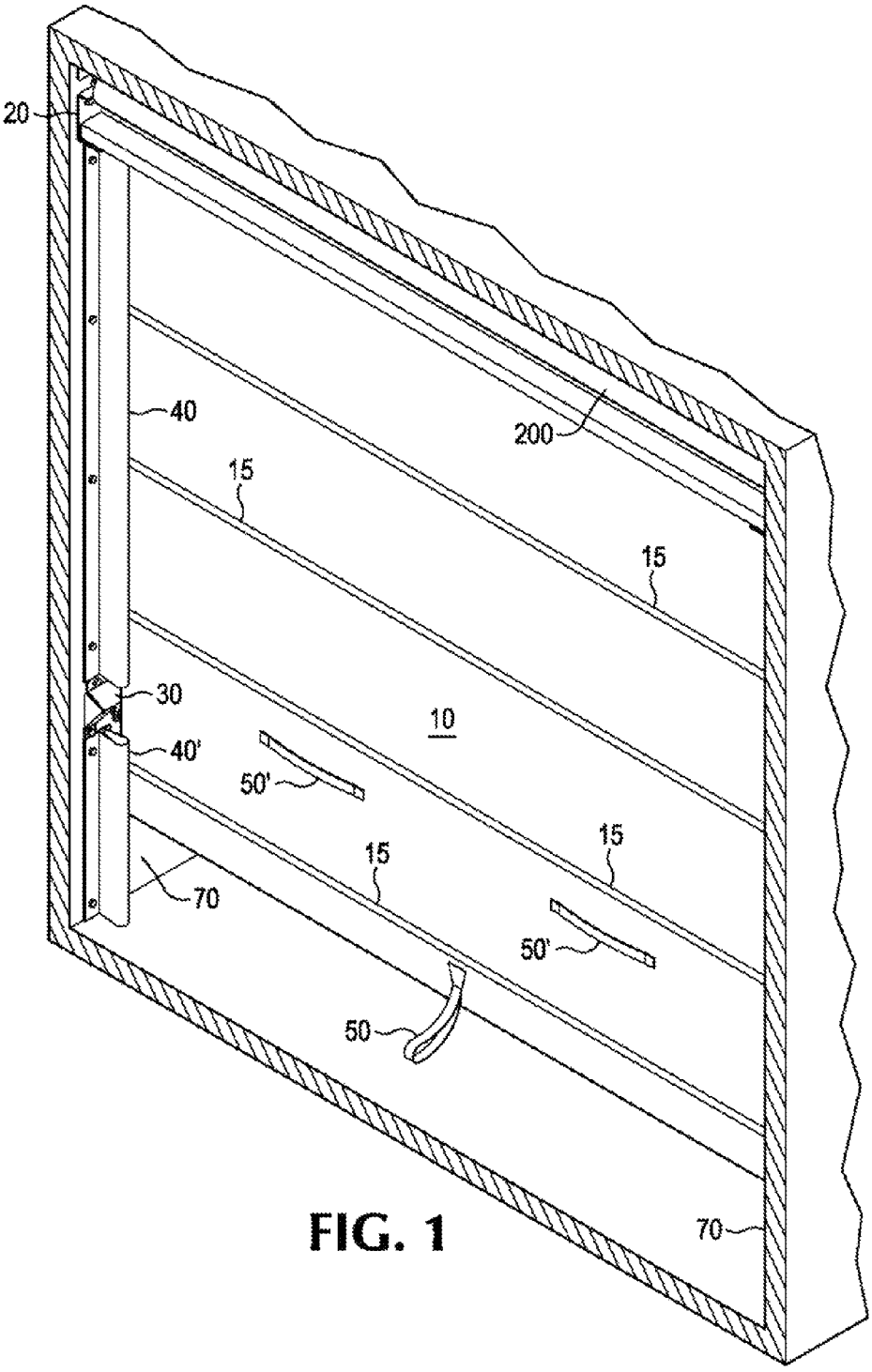
FIG. 1 is an isometric sectional view through a portion of a vehicle compartment, depicting an embodiment of the invention arranged as when installed and deployed for use, with the curtain remaining partially open.
Figure 13:
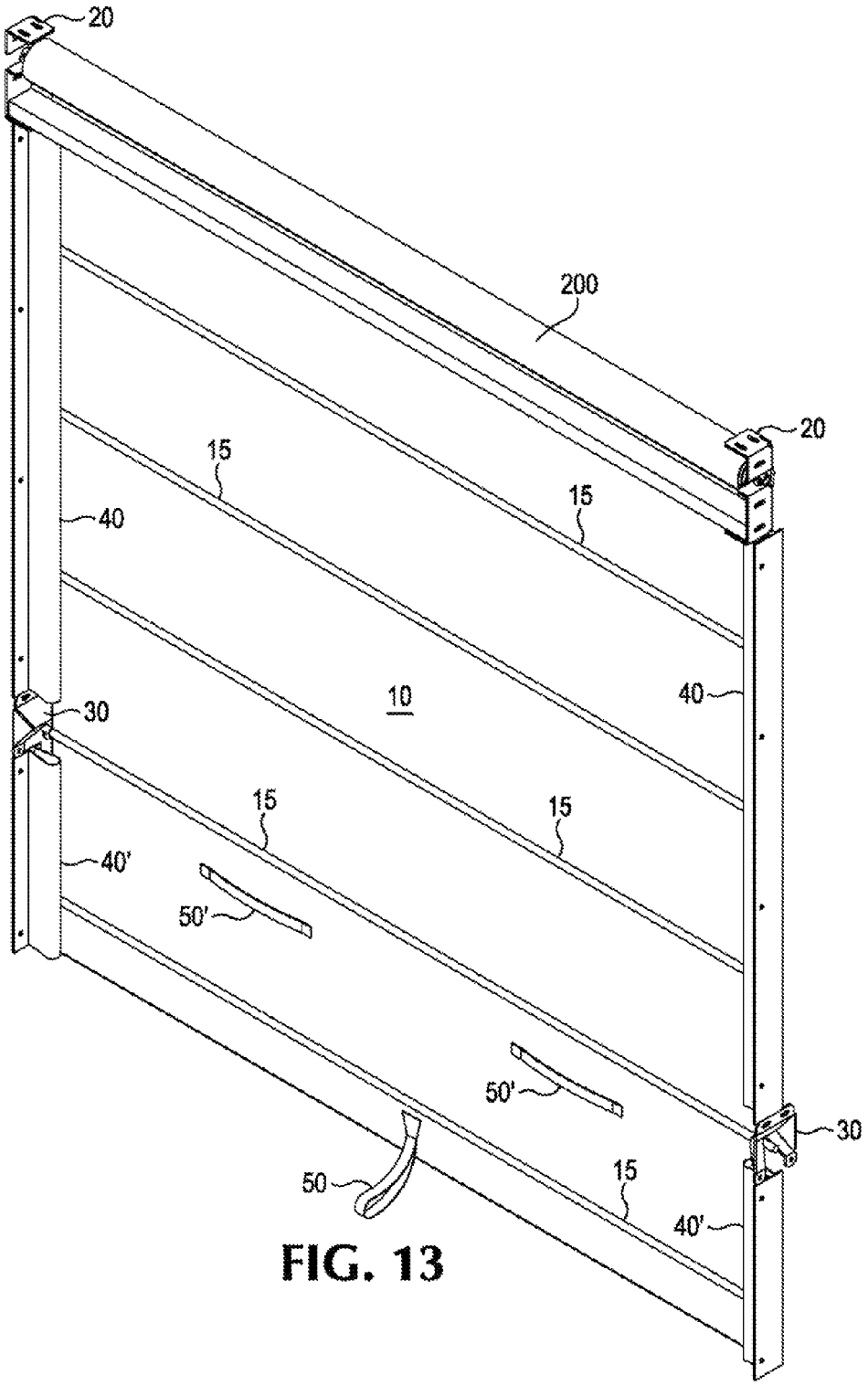
FIG. 13 depicts an isometric view corresponding to that depicted in FIG. 1, with the curtain fully deployed and engaged with the locking brackets as during use, according to an embodiment of the invention.

Throughout this description, references to features in the singular likewise includes the plural. Terms that indicate a position relative to some point of reference or orientation—e.g., 'above,' 'beside,' etc.—generally relate to the relative positions of features when the device is installed and deployed for use as shown in FIGS. 1 and 13, unless otherwise indicated or recognizable by an ordinarily skilled artisan in light of the specification and figures. The terms 'can' and 'may' are used herein to indicate that the described structure or arrangement is contemplated as to at least one embodiment, but is not necessarily present in all contemplated embodiments.

Referring first to FIG. 1, the inventive embodiments generally include a modular roll-down curtain 10, normally stored in a rolled condition and unrolled during use. The curtain 10 is formed from a flexible yet durable material and construction, and includes plural, vertically spaced apart and horizontally extending rods 15 extending through a width of the curtain. The rods add stability and a measure of rigidity, substantially preventing deflection of the curtain in response to applied forces, such as air pressure differentials at opposing sides of the curtain.

When rolled, the curtain wraps around an elongate, spring-loaded mandrel assembly 200 (also collectively referred to as a "mandrel" for descriptive convenience) having two opposing ends. Generally, a pair of mounting brackets 20 are permanently, semi-permanently, or removably mounted at upper portions of opposing, corresponding sidewalls 70 of a temperature-controlled compartment. Each mounting bracket is typically configured to receive and securely but detachably couple with one of the opposing ends of the mandrel, to enable secure yet interchangeable installation of the device.

During installation, each mounting bracket 20 of a pair of mounting brackets is first securely attached to a sidewall 70 in a position opposite the other mounting bracket of the pair. Then, the integral mandrel assembly 200 and rolled curtain 10 is lifted into place and securely yet detachably coupled with the mounting brackets. Because the mounting brackets are not integral to the mandrel assembly, there is no need to lift and hold the entire mandrel assembly in an immobile, elevated position while installing the mounting brackets. Likewise, the rolled curtain 10 and mandrel assembly 200 can be removed and replaced within minutes, typically without requiring removal or repositioning of the mounting brackets.

When installed, the curtain can be easily and manually unrolled downwardly, until it extends vertically from floor to ceiling, and horizontally from sidewall to sidewall, sealing off a portion of a temperature-controlled compartment. When unrolled during use, each of a pair of locking brackets 30, attached directly opposite one another and proximate a bottom of the opposing sidewalls below the mounting brackets 20, engage a rod 15 extending through the curtain 10 and retain the curtain in a deployed position. The locking brackets 30 each include an inverted V-shaped notch that securely engages and retains the rod (or another structure projecting from the curtain). Nevertheless, the notch typically allows the curtain to release from the locking brackets in response to a sufficiently strong impact or other force applied to either an inner or outer surface of the curtain, as is discussed in more detail below. Due to tension that develops in a mandrel spring when the curtain unrolls, the curtain automatically rolls up for stowage when released.

A side seal 40 extends vertically along the vertical track of movement of the rolling and unrolling curtain, providing a vertical sealing engagement along each side edge of the curtain. During use, the sides of the curtain generally overlap and confront an inner surface, or alternatively an outer surface, of the 'side seal' 40 material, forming a generally continuous lengthwise seal against air movement into or out of a portion of the compartment. The locking brackets may be mounted so that the inner apex of the V-shaped notch is offset a small amount (typically less than one inch) inwardly toward the temperature-controlled portion of the compartment relative to the vertical seals. The notch remains sufficiently aligned with the side seals for the curtain to contact a significant portion of the surface of the side seals when deployed, providing a barrier against air passage between the curtain and the side seals.

The curtain also generally includes one or more attached handles, straps or other manually graspable structures 50/50' disposed near, at, or extending downwardly beyond, a bottom edge of the deploying curtain, and useful for grasping and pulling the curtain downwardly for deployment, or for controlling the rate at which the curtain is recovered onto the mandrel for stowage. Such handles, etc. are typically beneficially positioned or configured so that they do not interfere with the curtain fully rolling up onto the roller. However, such handles, etc., or an extended end of a support rod or another structure can also be provided and configured proximate the bottom edge of the curtain to interfere with recovery of the curtain onto the mandrel, and therefore to limit the extent to which the curtain rolls up onto the mandrel for deployment.

When deployed in a fully closed position across an opening to a temperature-controlled area, the curtain extends from ceiling to floor, and from sidewall to sidewall (and overlapping the side seals), forming a barrier against uncontrolled air movement from a space on either side of the curtain to a space on an opposing side of the curtain. Gaps at the sides of the curtain are avoided or minimized by the curtain overlapping the side seals, and gaps at the bottom of the curtain are avoided by arranging the installed curtain and mandrel assembly and the locking brackets so that the bottom edge of the curtain extends fully to the floor of the compartment when deployed.

Other features of the inventive embodiments will become apparent to an ordinarily skilled artisan in light of the following descriptions and accompanying drawing figures.

Mandrel Assembly

Referring now to the more detailed images depicted in FIGS. 2-6, the mandrel assembly 200 includes the entire rigid shaft structure around which the curtain 10 is rolled when stowed. The mandrel includes an outer, typically cylindrical shaft 202 with a smaller-diameter inner cylindrical shaft 204 passing coaxially lengthwise through the outer shaft. The inner shaft can be either tubular or solid in alternative embodiments, and can include either or both of inner and outer reinforcing structures to maintain rigidity and resist deformation or material failure due to the instantaneous or accumulated effects of torque or other expected forces encountered during long-term use. Opposing ends 210/212 of the inner shaft each extend outwardly beyond corresponding opposing ends 206/208 of the outer shaft.

A 'collar' 214 is inserted into or otherwise coupled typically at each of the opposing ends 206/208 of the outer shaft 202. The outer, circumferential configuration of the collar 214 generally closely corresponds to the inner configuration of the outer shaft, enabling a close fit between the collar and the outer shaft. The collar is typically inset slightly within the outer shaft, leaving a 'rim' 218 formed of an end of the outer shaft extending beyond an exposed outer face 220 of the collar 214. Alternatively, the collar itself may include a raised circumferential rim, or lip, extending along an outer perimeter of its exposed outer face, with the rim lying adjacent to the outer shaft when the collar is disposed within the outer shaft. In either case the outermost portion of the rim 218 generally lies within or along, or defines, a plane that is outwardly disposed relative to (e.g, above) another plane formed by the outer surface of the collar, in a manner similar to a raised rim of a coin.

Each collar is fixed in position within and relative to the outer shaft by one or more fasteners 224 (e.g., screws, bolts, pins, etc.) extending through an opening 223 formed through the outside of the outer shaft and into a corresponding receiver opening 226 formed transversely into the outer, circumferential edge of the collar, for example, or by another suitable fastener or fastening means, whether removable and reusable, semi-permanent (e.g., rivets, adhesives, etc.), or permanent (e.g., welding, etc.).

Each collar typically includes a centrally positioned opening 225 ("central opening") extending through the collar from the outer face 220 to an inner face 222, sized and configured to allow passage of an end 210 of the inner shaft through the opening. When so positioned, the end of the inner shaft extends beyond the outer collar face 220 to a greater extent than does the corresponding end 206 of the outer shaft 202.

Figures 5, 6:
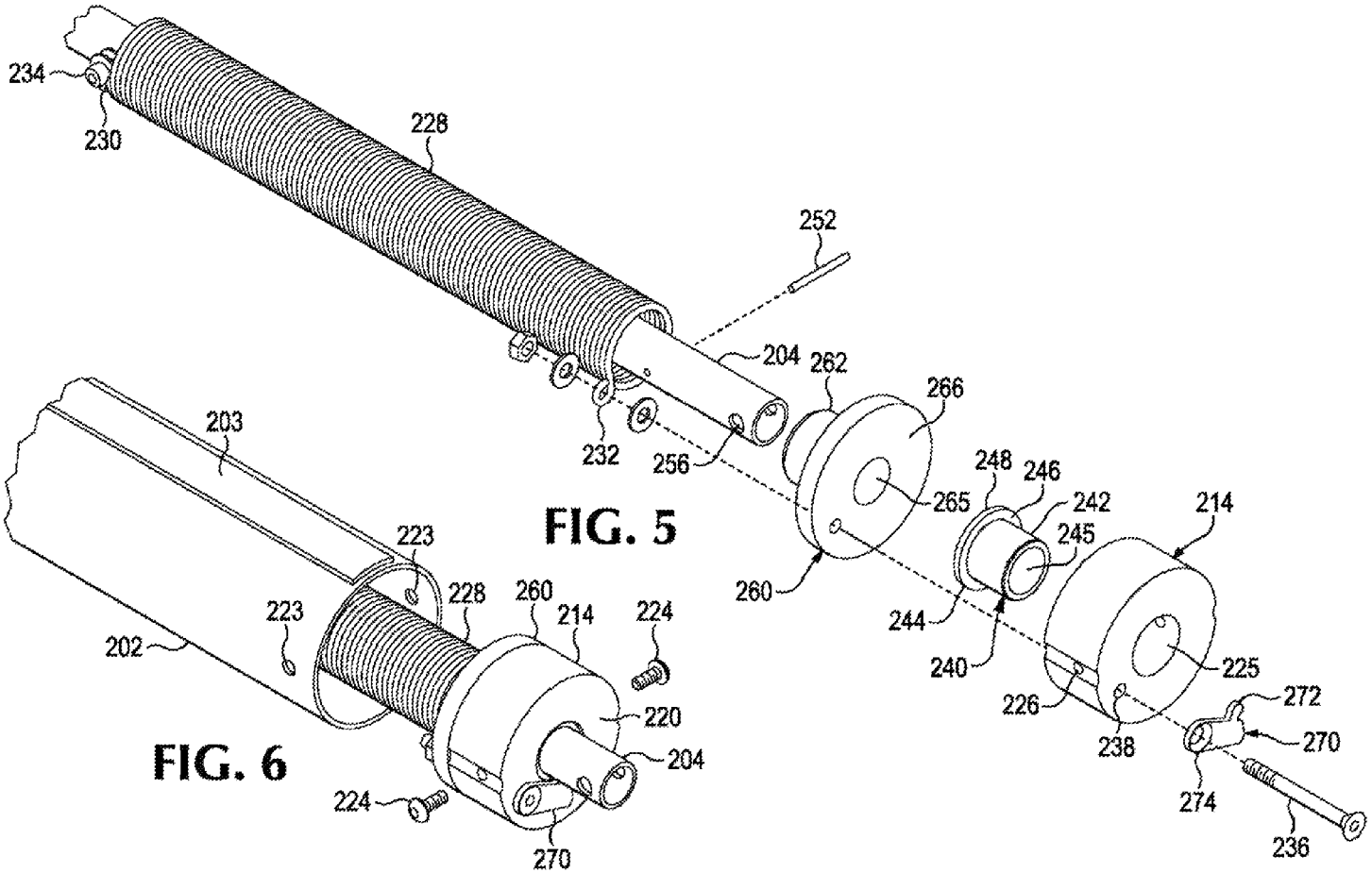
FIG. 5 is an isometric exploded view of the mandrel assembly of FIG. 3, but omitting the outer shaft to enable viewing of components otherwise concealed from view by the outer shaft.
FIG. 6 is an isometric partially-exploded view of the mandrel assembly of FIG. 3.

Within the outer shaft, the inner shaft also passes coaxially through a coil spring 228 that is attached at one end to the inner shaft, as shown at 230 in FIG. 5, by a fastener 234. An opposing end 232 of the spring 228 is fixed in position relative to the outer shaft 202 via a fastener 236 extending through a correspondingly configured opening formed through the collar 214 from its outer face 220 to its inner face 222. Therefore, coaxial rotation of the outer shaft relative to the inner shaft causes the spring to build and release spring tension. Indeed, when the spring is tensed due to such rotation, and no restraining force or structure is present, the accumulated potential energy within the spring drives counter-rotation of the outer shaft relative to the inner shaft to release such tension.

The spring 228 typically need not extend along the entire length of the inner shaft 204 within the outer shaft 202, and in some cases may extend less than half of such length. The length, diameter, coil count, material and other characteristics of the spring can vary substantially from embodiment to embodiment, to provide various tensioning conditions as determined to be suitable for any of various applications. An embodiment may likewise include two similarly configured, arranged and affixed springs, one at each end of the mandrel assembly.

In a preferred embodiment, a cylindrical portion 242 of a flange bushing 240 extends coaxially relative to and outwardly through the central opening 225 in the collar, with an outer face 246 of the bushing's flange 244 contacting the inner face 222 of the collar 214. Preferably, the flange 244 of the flange bushing 240 is inset partially or fully within a recess 250 formed into the collar's inner face. A central opening 245 formed through the flange bushing 240 is correspondingly configured to receive insertion of the inner shaft 204 through the flange bushing. An exemplary but non-exclusive flange bushing is formed of bronze, and is vacuum impregnated with a lubricant (e.g., SAE 30 oil, etc.), which transfers from the bushing to the inner shaft during rotation.

In at least one contemplated alternative embodiment, instead of a flange bushing, a ball bearing assembly can be provided about the inner shaft in the same position and for the same purpose as the flange bushing. An ordinarily skilled artisan can select to use either a flange bushing or a ball-bearing assembly as a design choice according to an intended use or performance preference, without departing from the scope and intent of the described embodiments.

A pin or likewise suitable fastener 252 extends transversely through the inner shaft 204 and contacts either an inner face 248 of the flange bushing 240 or the inner face 222 of the collar 214, preventing dislocation of the inner shaft 204 along its long axis relative to and outwardly through the central opening 225 in the collar. A corresponding pin at the opposite end of the inner shaft likewise prevents dislocation of the inner shaft relative to the collar coupled within the opposing end 208 of the outer shaft 202, effectively retaining the inner shaft 204 in position relative to the two collars.

Abutting an inner face 248 of the flange bushing ("first flange bushing") 240 and the collar 214, in an embodiment, is an outer face 266 of another flange bushing ("second flange bushing") 260 that is orientated one hundred and eighty degrees opposed to the first flange bushing. As with the first flange bushing, the inner shaft 204 likewise passes coaxially through a correspondingly configured central opening 265 extending through the second flange bushing 260. Unlike the first flange bushing, a ball bearing assembly is typically not interchangeable with the second flange bushing unless the ball bearing assembly is also structurally configured to serve as a spacer between the spring and the inner shaft.

A cylindrical portion 262 of the second flange bushing extends inwardly along and around the inner shaft 204 and within the coils of the spring 228, providing a spacer that maintains the spring spaced apart from the outer surfaces of the inner shaft, greatly reducing spring-to-shaft abrasion during use. The second flange bushing 260 is held in position partially due to its close association with each of the inner shaft 204 and the spring 228.

An end 210 of the inner shaft 204 extending beyond the outer face 220 of a collar 214 includes one or more circumferentially aligned 'latch' openings 254, each formed either partially or entirely through the diameter of the inner shaft, perpendicular to its long axis. One or more 'mounting' openings 256 are also provided outwardly along the end of the inner shaft relative to the latch opening(s) 254. The mounting opening(s) 256 are likewise formed either partially, or more typically entirely, through the diameter of the inner shaft, perpendicular to its long axis. The mounting openings 256 may also be provided as slotted (elongate) openings, or even as slots extending entirely to an end 210/212 of the inner shaft in an embodiment, to accommodate for slight variations in a separation distance between opposing mounting brackets to which the mandrel assembly 200 is to be coupled.

A latch mechanism 270, typically flattened in profile, is pivotably coupled at the outer face 220 of the collar 214, preferentially but not exclusively by the same fastener 236 that extends through the collar and retains one end 232 of the coil spring 228, as described above. The latch mechanism 270 is positioned between the inner shaft 204 and the outer shaft 202, and lies in a planar-parallel relation with the collar outer face 220. The latch mechanism pivots about the shank of the fastener in an arc of motion lying planar-parallel relative to the collar outer face 220, as confined by the rim 218 of the outer shaft 202. An outer surface of the latch mechanism can be beveled surrounding the opening for the fastener, as shown at 274 in FIG. 5, corresponding to a likewise beveled fastener end, to facilitate the described pivoting movement of the latch mechanism.

The latch mechanism 270 includes a projection 272 orientated inwardly toward the inner shaft 202. Pivoting the latch mechanism inwardly—manually or otherwise—enables the projection 272 to alternatingly engage or disengage a latching opening 254 of the inner shaft 204, alternatingly prohibiting or permitting rotation of the outer shaft relative to the inner shaft.

The projection includes two engagement portions, or 'faces,' which, when the projection engages with a latch opening 254, are brought into confrontation with one or another of opposing interior edges of the latch opening, depending upon a direction that the outer shaft rotates relative to the inner shaft. An 'inner' face of the projection proximate to the fastener 236 typically forms an obtuse angle with an edge of the latch mechanism from which it projects. Therefore, when the latch is engaged with the latch opening, and the outer shaft rotates relative to the inner shaft as during deployment of the curtain, an inner edge of the latch opening contacts and displaces along a face of the projection 272 that forms one side of the obtuse angle, causing the latch mechanism 270 to pivot outwardly and to disengage from the latch opening 254.

Conversely, an opposing 'outer' face of the latch mechanism's projection 272 includes a notch, or forms an acute angle with the latch mechanism, into which an inner edge of a latch opening can be received and retained in the event of counter-rotation of the outer shaft relative to the inner shaft. If the latch mechanism has been engaged with the latch opening, such counter-rotation (as during recovery of the curtain onto the outer shaft) typically firmly secures the latch mechanism in a latching engagement between the latch mechanism and a corresponding inner edge of the latch opening 254.

However, the latch mechanism generally does not spontaneously pivot to a locking position in response to centrifugal forces, therefore avoiding inadvertent locking of the mandrel during use. Additionally, the flattened latch mechanism 270 generally lies within a recess formed at the outer face 220 of the collar 214 by the rim 218 of the outer shaft 202, remaining manually accessible to a user but unlikely to detrimentally interfere with structures lying beyond the end of the outer shaft.

The configuration of structures at both ends of the mandrel may be identical, such as when two coil springs are utilized. However, a preferred embodiment includes a spring at only one end of the mandrel, to reduce weight and simplify assembly. The mandrel may either include a latch mechanism at both ends, or only at one end, according to alternative embodiments.

Curtain

Figures 7, 8:
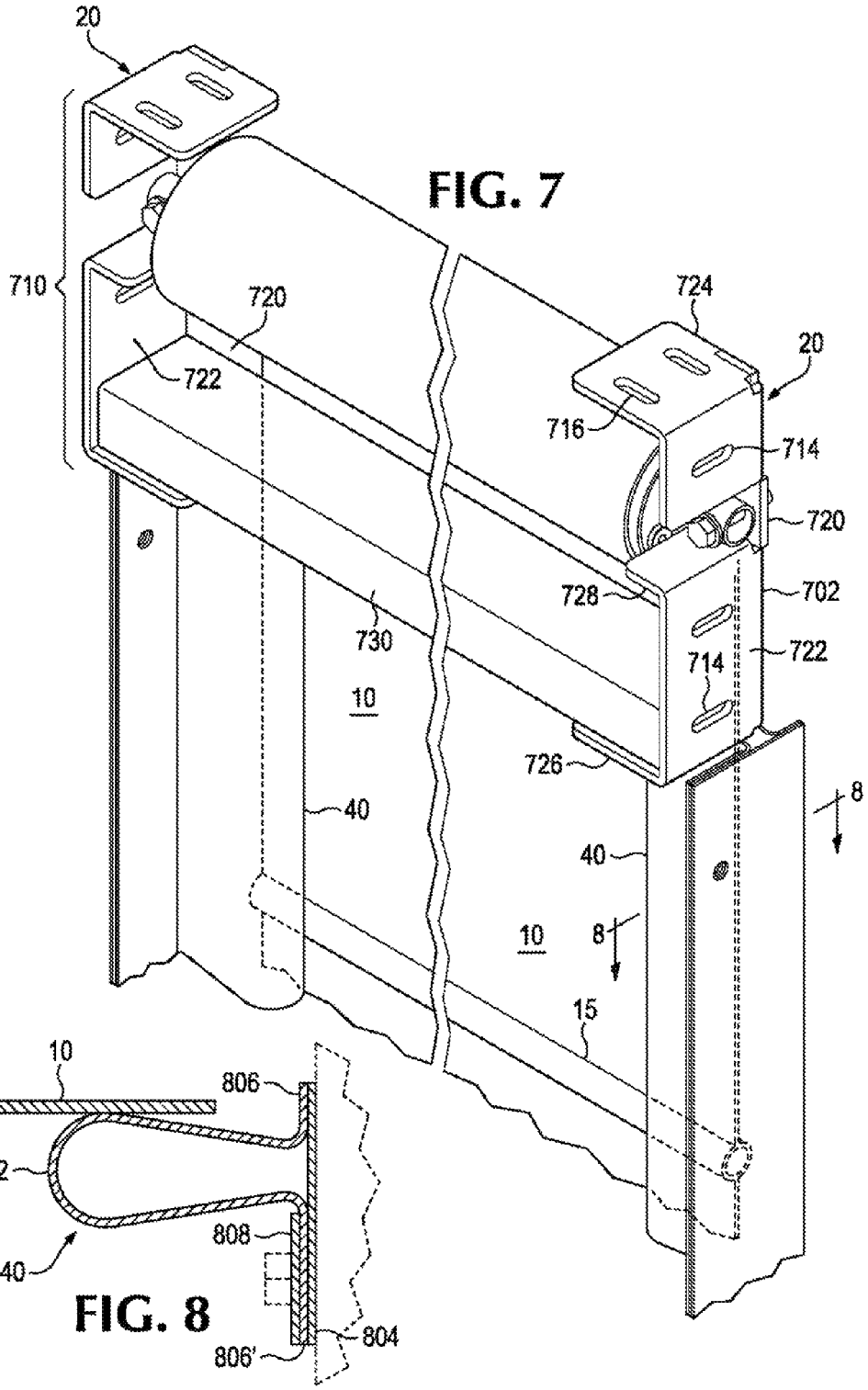
FIG. 7 is an isometric view depicting the mandrel assembly, mounting brackets, and portions of a curtain and side seals, as arranged when installed and deployed for use according to an embodiment of the invention.
FIG. 8 is a plan sectional view of a side seal and a curtain portion of FIG. 7 taken along the line indicated as 8-8.

Referring now to FIG. 7, the curtain 10 is typically a continuous, durable yet flexible material, such as—but not limited to—fiber reinforced vinyl. The contemplated embodiments likewise include the curtain being formed of other suitably durable, flexible, generally air-impermeable materials. The width of the curtain corresponds closely to and typically does not exceed the length of the outer shaft 202 of the mandrel 200. The length of the curtain can vary in different embodiments, but will typically be configured to extend, when deployed, approximately the entire height of an opening to a compartment intended to be protected by the curtain (as shown in FIG. 13), and can be marginally longer so that a portion of the curtain remains wrapped about the mandrel assembly even when fully deployed during use.

Figure 12:
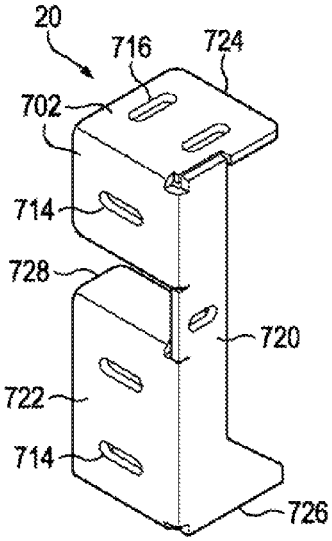
FIG. 12 is an isometric view of a mounting bracket corresponding to one of those shown in FIG. 7, as viewed from another angle.

Horizontally-orientated rigid or semi-rigid rods 15 are spaced apart at typically regular intervals, as shown in FIGS. 1 and 12, coupled with the curtain along either of its opposing front surface or back surface, or sandwiched between the opposing surfaces. Only one rod is typically present at each position. Placing one or more of the rods at the surface of the curtain opposite the side seals, rather than at the curtain surface that faces the side seals, can beneficially enhance sealing of the curtain against a side seal.

The separation between rods can preferably be configured so that, when the curtain is rolled up onto the outer shaft of the mandrel, the rods are offset from one another—e.g., a rod does not overlap, overlie, or cross over an underlying rod in the rolled curtain—and therefore the rods do not greatly increase the diameter and asymmetry of the overall rolled curtain. The rods may be formed of nylon, polyvinyl chloride (PVC), aluminum, fiberglass, wood, carbon fiber, or another preferably lightweight but relatively rigid material or combination of materials. Each rod may preferably have a diameter within the range of three-sixteenths of an inch to one-half inch (3/16"-½"), although the diameter of any one of the rods can vary from another of the rods, and a diameter of a rod can vary along its length in an embodiment, such as to provide differing levels of flexibility or rigidity at different portions of a curtain.

Each rod is preferably a single integrated unit, but can alternatively be formed of two or more rod portions aligned and attached to one another in a linear end-to-end arrangement. In the latter configuration, the rod portions can attach to one another in a peg-in-socket manner, and can also be connected by an extensible, resilient cord passing lengthwise sequentially through the two or more rod portions, in the manner similar to shock-corded fiberglass or carbon fiber tent posts, for example. Of course, these specifically described configurations are exemplary only, and are not intended to limit the broader range of contemplated and reasonably expected methods and configurations for providing such elongate rod structures.

The rods may be retained within a folded length of material that is coupled (e.g., sewn) to the curtain, or within a pocket formed by folding a portion of the curtain back on itself and affixing it in such position, or within a pocket formed between two layers of a multi-layer curtain by stitching or another fastening means (e.g., grommets, rivets, adhesives, etc.) disposed on each side of the rod (e.g., above and below). However attached, the rods generally do not spontaneously and substantially dislocate longitudinally during use, although the rods may typically be removed and replaced if needed.

The upper edge of the curtain is preferably attached to the mandrel via corresponding strips of a hook and loop fastening material—e.g., one or more strips coupled longitudinally along the mandrel outer shaft (as shown at 203 in FIGS. 3 and 6), and one or more corresponding strips coupled along the upper portion of the curtain—although other means for fastening the curtain to the mandrel (e.g., an adhesive, screws, clips, etc.) are also contemplated.

Mounting Brackets

Continuing in reference to FIG. 7 and also FIG. 12, an exemplary embodiment of the invented device further includes two mounting brackets 20, each typically a mirror image of the other. A mounting bracket 20 may generally be formed from a single rigid, formable, typically metal sheet material (e.g., one-eighth inch to one-quarter inch thick sheet metal). In a typical embodiment, the 'bracket body' is separated from a larger expanse of such material, then is bent and typically tack welded into its final configuration, as shown in FIGS. 7 and 12. Alternative methods (e.g., casting, extrusion, machining, etc.) may be used to form metallic mounting brackets, and when alternative materials are used, such as high density polymers, resins, etc., an ordinarily skilled artisan will recognize that alternative methods may also be suitable, such as injection molding, thermoforming, etc.

An exemplary mounting bracket 20 typically includes a vertical spine 702, which, prior to bending into its final form, has a greater width at its center than at each of its opposing 'upper' 724 and 'lower' 726 ends, and the opposing upper and lower ends are both generally offset to one side of the width of the mounting bracket, as shown. The central portion 710 of the spine is bent ninety degrees (90°) along the long axis of the mounting bracket, with the bend being either aligned with or beyond an edge of the opposing ends, so that the opposing ends and a 'base plate' portion 722 of the mounting bracket lie in a plane perpendicular to the now angled "securing flange" 720 portion of the bracket. The base plate 722 preferably includes plural horizontally slotted openings 714 formed fully through it, with the openings being positioned at intervals (whether regular or irregular) between the two opposing ends of the mounting bracket. The slotted openings 714 are generally orientated perpendicular to the long axis of the bracket, and are configured to receive insertion of fasteners (e.g., bolts, lag screws, rivets, etc.) for coupling the mounting bracket securely to a vertical surface of a sidewall 70.

Each of the opposing ends 724/726 of the base plate 722 are bent toward one another until the facing surfaces of the opposing ends lie in a planar-parallel relationship relative to each other, and at an angle of ninety degrees (90°) relative to each of the base plate 722 and the securing flange 720. An edge of each opposing end can then be welded to an adjacent edge of the securing flange, adding rigidity to both structures and to the mounting bracket as a unit. One or more openings 716, preferably although not exclusively slotted, are likewise provided through each of the opposing ends of the mounting bracket. The openings in the upper end of the mounting bracket are positioned and configured to receive insertion of fasteners for coupling the mounting bracket securely to a horizontal surface (e.g., the ceiling of a compartment) directly above the mounting bracket. The purpose of the holes in the lower end of the bracket is discussed below.

A mandrel support ledge 728 is also provided along an 'inner' face of the base plate 722. For example, an upper portion of the base plate 722 can be separated transversely from its lower portion, with the line of separation extending across the base plate from an edge opposite the securing flange 720 until arriving at the angled junction between the base plate and the securing flange. The line of separation then turns ninety degrees (90°) and proceeds along the base plate at the edge of the angled junction for a distance that is less than the distance by which an end 210/212 of the inner shaft 204 of the mandrel 200 extends beyond a corresponding end 206/208 of the outer shaft 202. A tab formed by the separation is then bent ninety degrees (90°) inwardly in the orientation as the opposing ends 724/726 of the mounting bracket, until the tab lies in a planar-parallel relationship with each of the opposing angled ends of the mounting bracket, forming the mandrel support ledge 728. The tab can then be welded to the securing flange 720, to provide additional stability and rigidity to both structures.

An additional opening (not shown) is formed centrally through the portion of the securing flange 720 adjacent to the mandrel support ledge, to receive insertion of a fastener for securing the mandrel assembly to the mounting bracket. The center of the opening is typically disposed above the upper surface of the mandrel support ledge by a distance that is approximately equivalent to the radius of the inner shaft 204 of the mandrel 200.

Additionally, a guard bar 730 is provided in an embodiment, resting upon and coupled at its opposing ends with the inwardly bent lower ends 726 of the mounting brackets. The guard bar is typically formed of a rigid or semi-rigid material and configuration, and serves to prevent objects from striking and causing damage to the rolled curtain and mandrel assembly. For example, the guard bar may most typically be formed of an elongate tube, channel, I-beam, bar, or other similar configuration, and may be formed of a metal (e.g., steel, aluminum, etc.) or alloy of metals, fiberglass, rigid polymer material, or another similarly suitable material or configuration that will extend between the opposing mounting brackets with minimal sagging, and will reduce a likelihood that an object will strike the mandrel assembly or rolled curtain. The guard bar is typically coupled with the mounting brackets by one or more removable fasteners extending though corresponding opening(s) (not shown) provided through each mounting bracket lower end 726.

During installation, the end of the mandrel inner shaft rests supported upon the tab, relieving the user from the burden of holding the mandrel assembly aloft, in position, and stable throughout installation. The user inserts a fastener (e.g., bolt, a clevis pin, etc.) horizontally through the mounting opening 256 of the inner shaft and through the opening in the securing flange, and depending on the type of fastener used, securely yet detachably couples the mandrel to the mounting bracket with a reciprocal fastener (e.g., a nut, a cotter pin, etc.).

In use, an exact distance between opposing sidewalls of a compartment can vary somewhat, which can also cause variations in a separation distance between opposing mounting brackets with which a mandrel assembly is to be attached. In cases where the variation is too great to be accommodated by slotted mounting openings 256, and in other contemplated and advantageous embodiments, the invention contemplates the use of mandrel rod inserts, referred to as "plug extensions" below for convenience, fitted into and extending outwardly from each of the opposing ends 210/212 of the mandrel's inner shaft 204.

Each plug extension includes a first end, generally but not exclusively cylindrical in transverse cross-section, and configured for insertion into an end of the inner shaft with a close but sliding fit between the plug extension and the inner shaft. The length of the plug extension that inserts into the inner shaft can vary across embodiments, but preferably will be equal to or greater than the internal diameter of the inner shaft.

A shoulder or other external structure of the plug extension can be provided at a second 'outer' end of the plug extension, and configured to encounter the end of the inner shaft during insertion and to limit and define a depth of insertion of the plug extension into the inner shaft. One or more openings provided into the plug assembly can align with the one or more of the mounting opening provided at the end of the inner shaft, to receive insertion of a fastener for securely yet detachably coupling the plug extension with the inner shaft end.

Alternatively, the insertable portion of the plug extension includes one or more spring-loaded pins that can be manually depressed into the interior of the plug extension. When the plug extension is slid into the inner shaft, the spring loaded pin(s) arrive at the mounting opening(s) 256, releasing each spring-loaded pin into a mounting opening and securing the plug extension within the end of the inner shaft.

According to yet another embodiment, either an interior or an exterior of the inner shaft end can be threaded, and either an end of the plug assembly is correspondingly threaded to screw into the end of the inner shaft, or the end of the plug assembly is formed as a threaded collar to screw onto the end of the inner shaft.

The opposing end of the plug extension is configured to simulate the end of the inner shaft, including mounting openings for securing the end of the mandrel assembly to a mounting bracket in the same manner as if securing the actual inner shaft itself. Alternatively, because the plug insert does not pass through the collar, spring, and other components during assembly of the mandrel assembly, the outer portion of the plug assembly can be non-cylindrical in cross-section (e.g., rectangular, ovoid, triangular, etc.), or can be larger in diameter than the inner shaft, for example, although the outer diameter of the plug extension will preferably be approximately the same as the outer diameter of the inner shaft. Likewise, the plug extension can be formed of a different material than the inner shaft, can be either solid or hollow, or can vary in other respects as would be apparent to an ordinarily skilled artisan without departing from the spirit and scope of the invention. Embodiments of a mandrel assembly utilizing plug extensions are further described below with reference to FIGS. 14-20.

Figure 21:
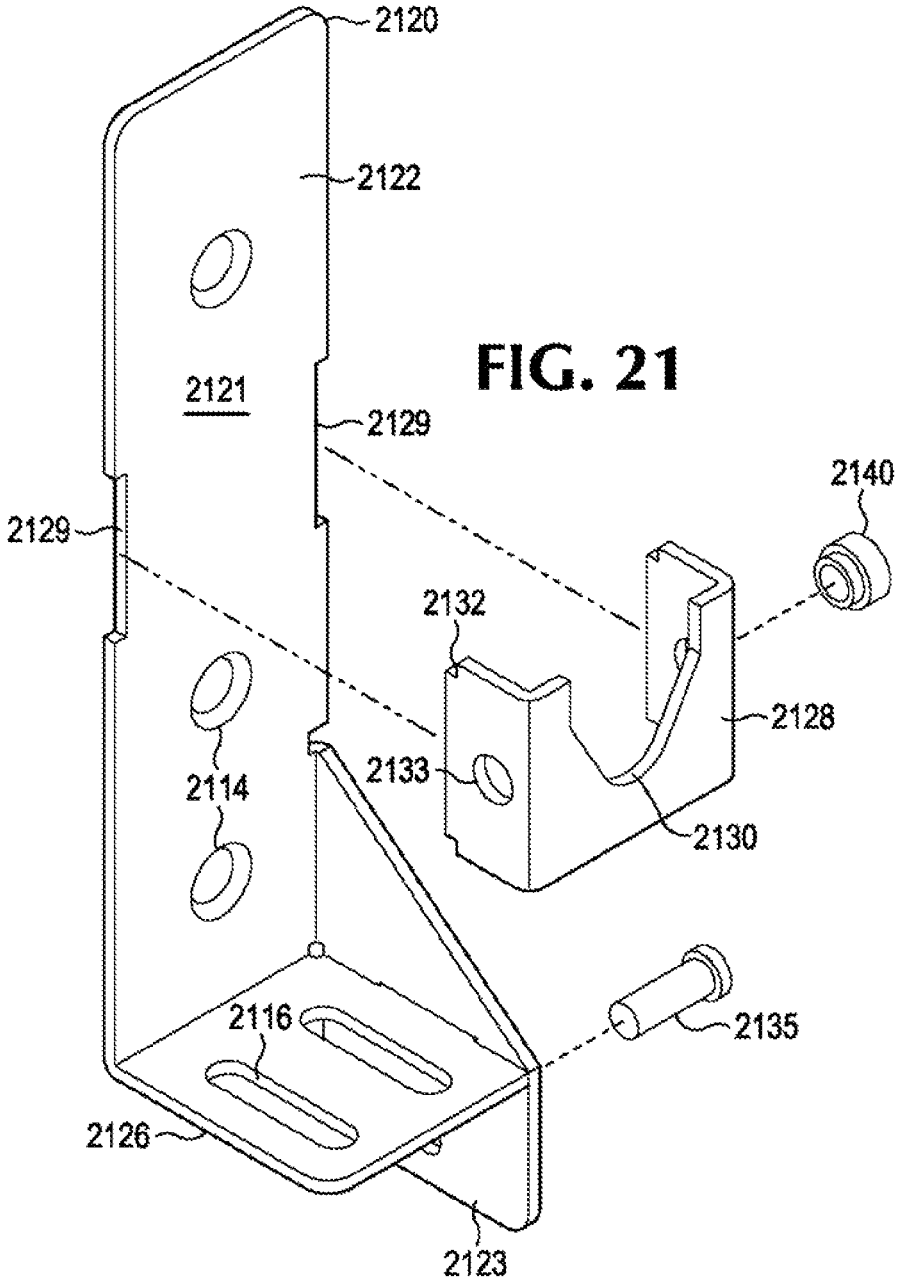
FIG. 21 is an isometric exploded front view of a mounting bracket according to another embodiment of the invention.
Figure 22:
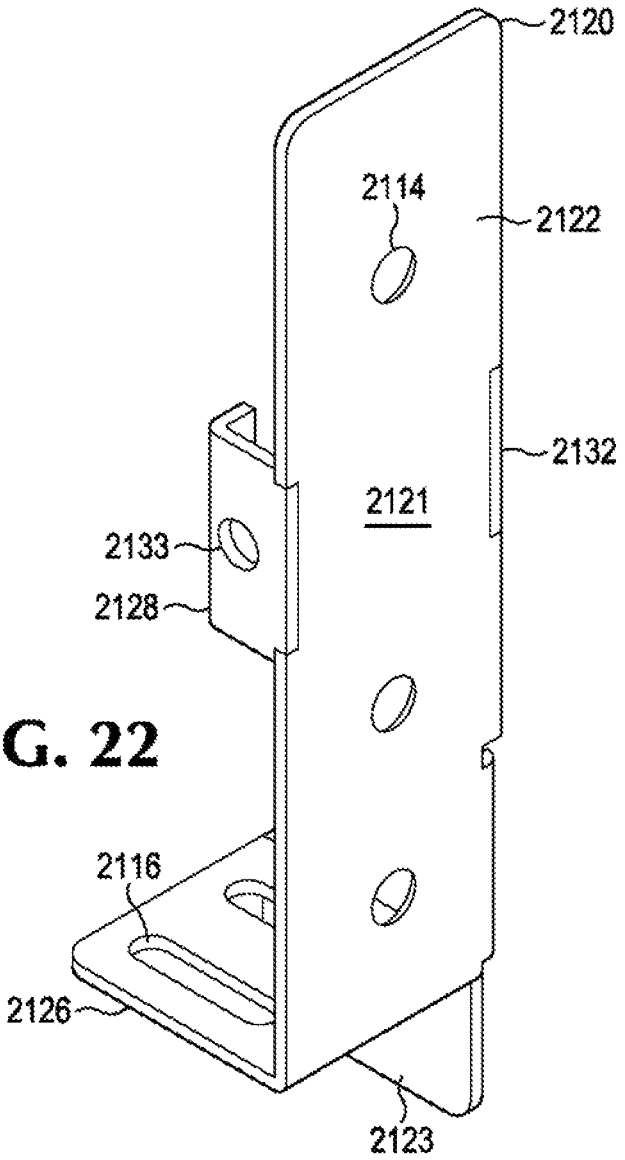
FIG. 22 is an isometric rear view of an assembled mounting bracket, corresponding to and used in a mounting bracket pair with the mounting bracket depicted in FIG. 21.

According to an exemplary, simplified embodiment of a mounting bracket 2120, as shown in FIGS. 21 and 22, an upper portion 2121 of a base plate 2122 is formed as a generally flat strap formed of a rigid material, typically metal. A lower end 2126 of the base plate extends perpendicularly relative to the upper portion, and a 'side' gusset 2123 coupled with a side of the base plate 2122 adjacent to the lower end 2126 extends perpendicularly relative to both the upper portion 2121 and the lower end 2126. The side gusset 2123 can be securely coupled with the lower end 2126, such as by welding, and provides a durable support structure preventing downward flexion of the lower end in response to an applied load. The side gusset 2123 can likewise be provided with a slot, and lower end 2126 can be provided with a corresponding tab configured to align with and insert into the side gusset slot, further providing means for achieving a secure and supportive engagement between the side gusset and the lower end.

A mandrel support 2128 is coupled with the base plate 2122. Notches 2129 formed into opposing sides of the upper portion 2121 of the base plate 2122 are configured to receive respective opposing ends of the mandrel support 2128, which in turn may be provided with a correspondingly configured tab portion 2132. The mandrel support 2128 is securely coupled with the base plate, most typically by welding the two components together along adjacent portions of each.

A central portion of the mandrel support 2128 includes an upwardly-orientated, generally triangular notch 2130 with a rounded apex configured to receive and support either of a plug extension or an end of an inner shaft of a mandrel assembly. As shown in FIG. 21, aligned openings 2133 formed through opposing side portions of the mandrel support are configured to receive insertion of a bolt, pin, or other fastener. The aligned openings 2133 are also disposed to align with an opening formed transversely through an end of either of a plug extension or an end of an inner shaft of a mandrel assembly.

A captive nut 2140 is optionally coupled with the mandrel support at one of the aligned openings 2133 as shown in FIG. 21, such as by welding or some other generally recognized attachment means or method, to receive an end of a bolt inserted though the aligned openings 2133 and the mandrel assembly, and to secure the bolt in place. The captive nut 2140 may be threaded to engage corresponding threads of the bolt, or may couple with and secure an alternative fastener in some other suitable manner. Alternatively, instead of a captive nut coupled with the mandrel support, an uncoupled nut can be used. Preferably, a nylon locking nut beneficially prevents inadvertent disengagement of the mandrel assembly from the mounting bracket due to vibration during use.

A captive stud 2135 is likewise optionally inserted through an opening formed into and through the side gusset 2123, typically but not exclusively on the same side of the mounting bracket as the nut 2133. The captive stud can be either permanently or detachably coupled with the side gusset 2123, in alternative embodiments. The shaft of the stud 2135 extends beyond the side gusset and beneath the lower end 2126 of the mounting bracket. When installed for use, the stud engages securely with a corresponding opening provided at an upper portion of a side seal, which can then be secured in position by coupling a corresponding fastener with the stud (e.g., a nut, cap, cotter key, etc.). When so engaged, the stud improves side seal rigidity, and ensures that that the side seal will not interfere with the curtain's motion when deploying from its fully rolled up position to an extended, rolled-down position during use.

Figure 14:
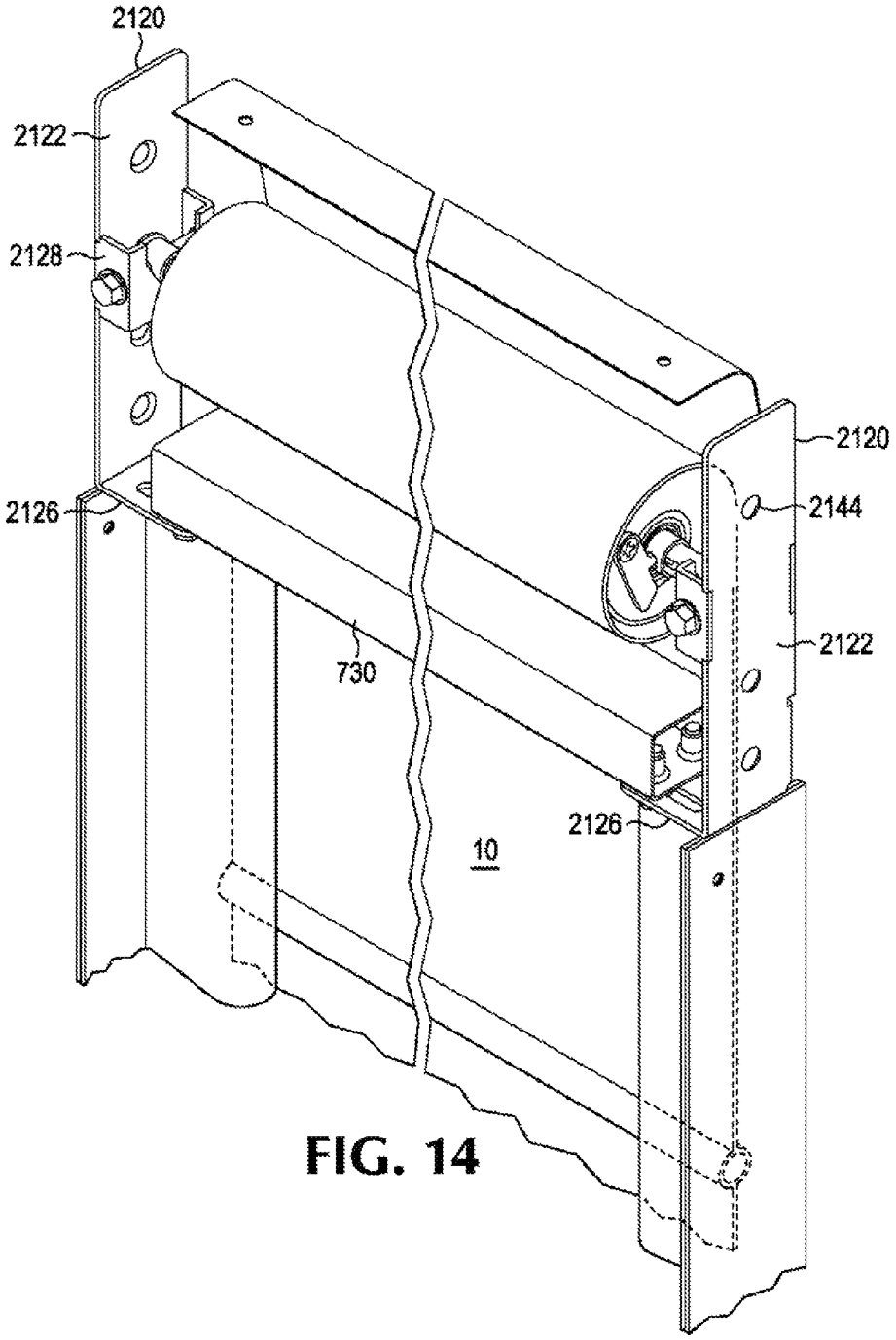
FIG. 14 is an isometric view depicting the mandrel assembly, mounting brackets, and portions of a curtain and side seals, as arranged when installed and deployed for use, according to another embodiment of the invention.

The exemplary mounting brackets in FIG. 21 further include vertically-aligned openings 2114 formed through the base plate 2122, for receiving fasteners. Such vertical alignment enables the fasteners to securely engage with a relatively narrow, vertical structural member located behind the side wall, for example, to retain the mounting bracket securely in position. The mounting brackets likewise include slotted openings 2116 formed through the lower end 2126 and orientated to extend lengthwise away from the base plate. When in use, a guard bar 730 is typically, but not exclusively, coupled at each end to a mounting bracket via one or more fasteners extending through the slotted openings 2116 and corresponding openings at each end of the guard bar 730, as shown in FIG. 14. The slotted openings allow for moderate variations in a separation distance between the two mounting brackets in use, or slightly varying guard bar lengths, easing assembly during installation within a compartment.

The view shown in FIG. 14 corresponds to that shown in FIG. 7, but FIG. 14 depicts a mandrel assembly, mounting brackets, and portions of a curtain and side seals, according to another embodiment of the invention. The mounting brackets depicted in FIG. 14 correspond to those shown in FIG. 22 and discussed above. The curtains and side seals generally correspond to those shown in FIGS. 1, 2, 7, and 8, and are not discussed in further detail here. However, the structure and arrangement of features of the mandrel assembly vary from those depicted in FIGS. 3-6, two exemplary embodiments of which are now described with reference to FIGS. 15-20.

First Alternative Embodiment of the Mandrel Assembly

Figure 15:
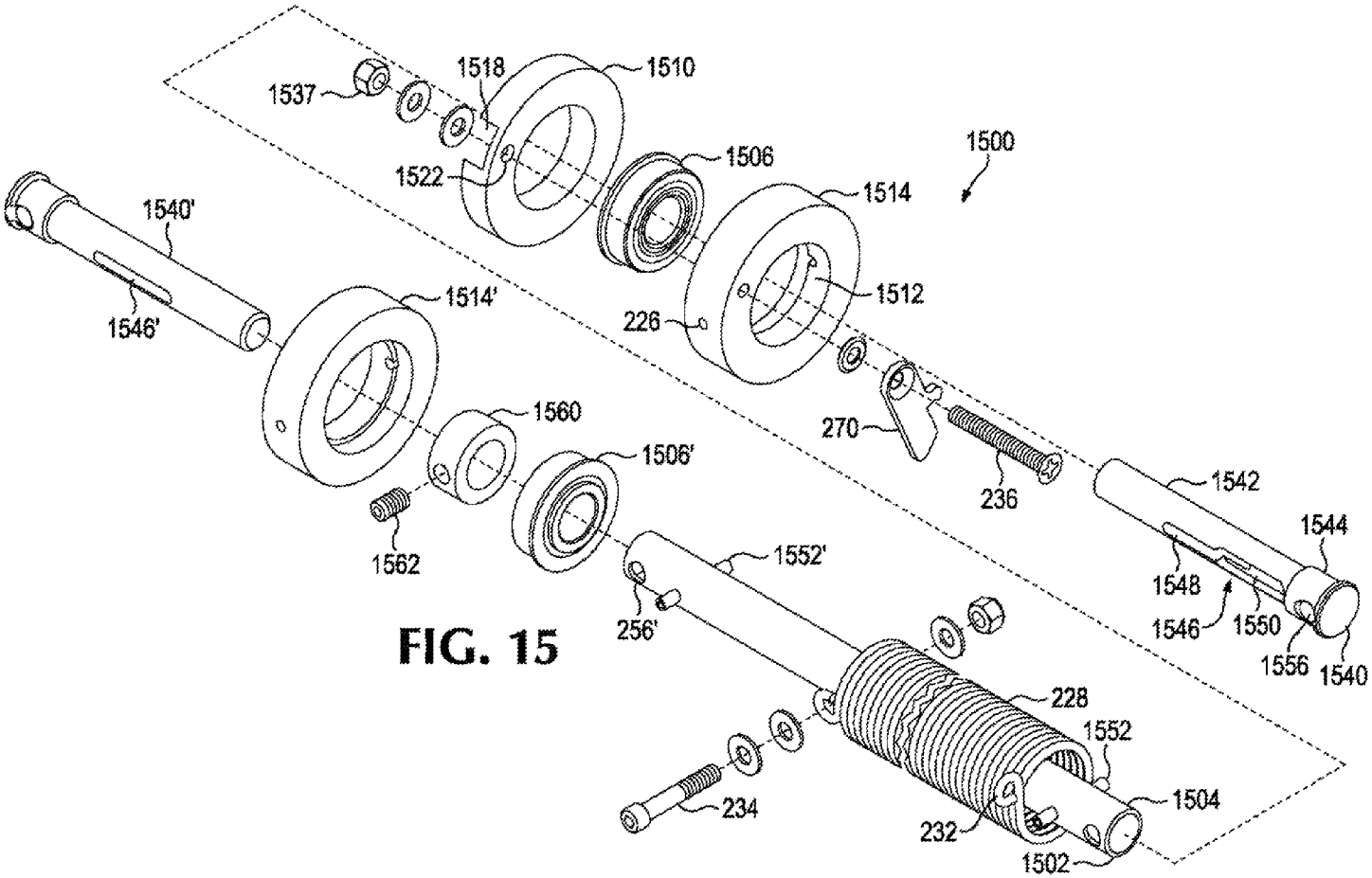
FIG. 15 is an isometric exploded view of a mandrel assembly, but omitting the outer shaft to enable viewing of components otherwise concealed from view by the outer shaft, according to another embodiment of the invention.
Figure 17:
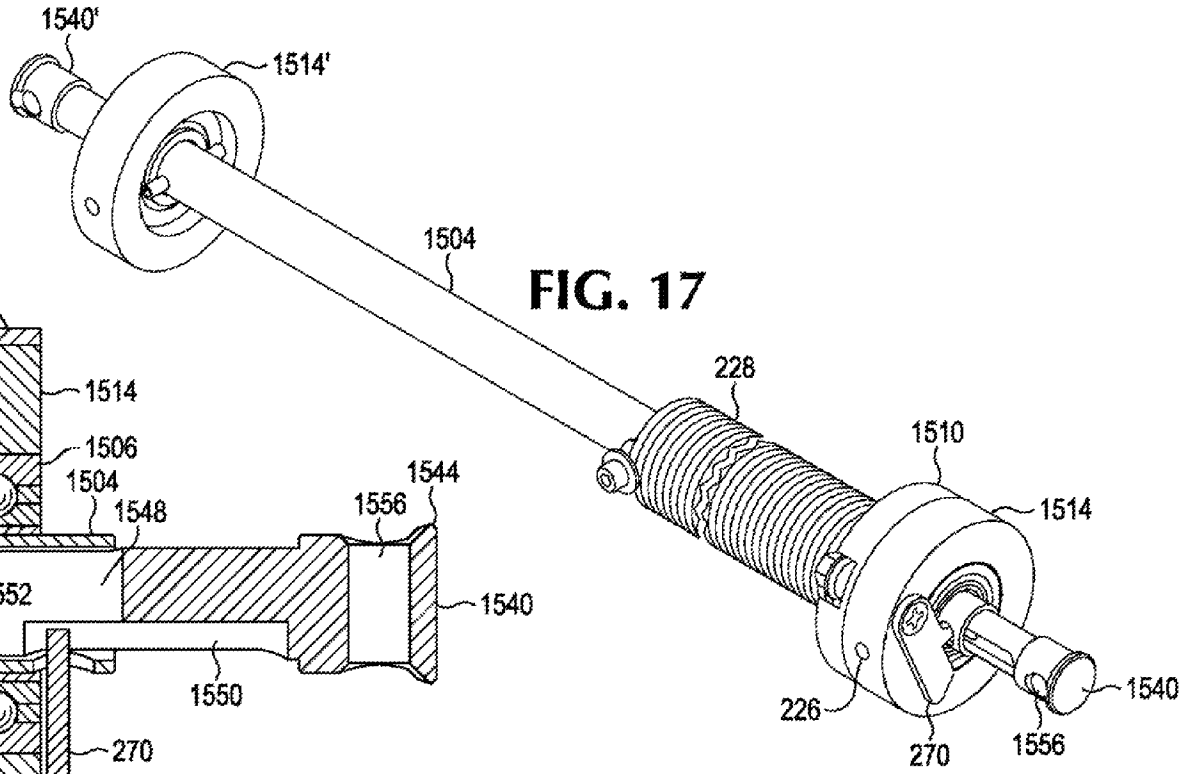
FIG. 17 is an isometric fragmentary view of the mandrel assembly for FIG. 15, but omitting the outer shaft to enable viewing of components otherwise concealed from view by the outer shaft.
Figure 16:
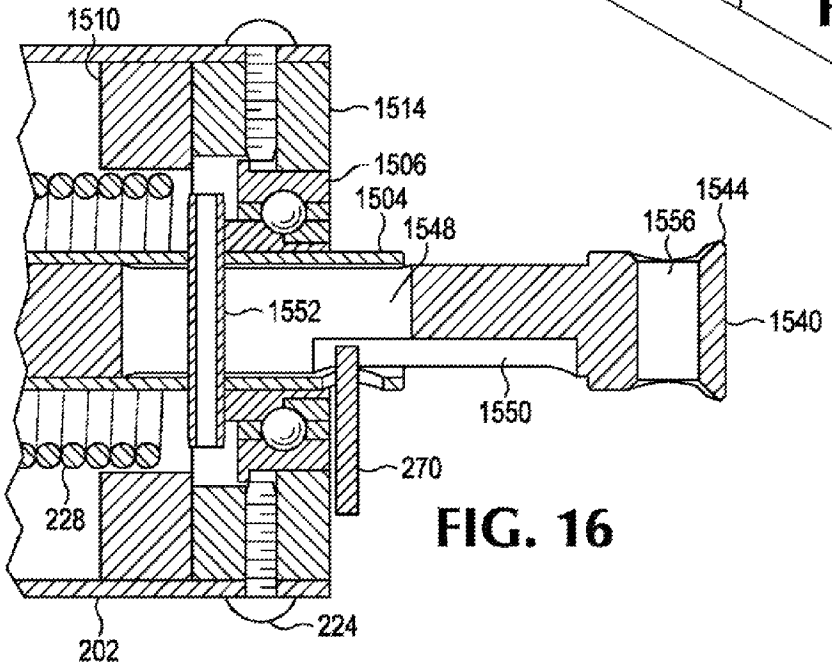
FIG. 16 is a sectional view of an end of the mandrel assembly of FIG. 15 taken along an axis corresponding to line 4-4 of FIG. 3.

FIGS. 15-17 depict the mandrel assembly according to another contemplated embodiment.

FIG. 15 depicts an isometric exploded view of a mandrel assembly 1500 according to a first exemplary alternative embodiment. At a first end 1502 of the inner shaft 1504, a collar assembly comprises a flange bearing 1506 captured between a collar end ring 1514 and an adjacently disposed collar spacer ring 1510. An outer cylindrical portion of the flange bearing, housing ball bearings and an inner rotating cuff portion, inserts through a central opening 1512 of the collar end ring. The flange of the flange bearing nests within a concentric shelf formed into the collar end ring along an inner edge of the central opening, and abuts a shoulder of the shelf. The position of the shoulder relative to the thickness of the collar end ring and of the flange is generally configured so that the outer face of the flange bushing does not extend beyond a plane extending along the outer face of the collar end ring. Likewise, the inner face of the flange bearing generally does not extend beyond a plane extending along the inner face of the collar end ring. Accordingly, the thickness of the flange bearing between its respective inner and outer faces generally relates closely to but does not exceed that of the collar end ring.

An outer face of the collar spacer ring confronts the inner face of the collar end ring, and prevents the flange bearing from dislodging from its position during assembly and use. The collar end ring and collar spacer ring can be coupled together, such as by welding, or an adhesive, or by a fastener inserted through engaging both structures in an adjacent, cylindrical arrangement and assembly, generally having a uniform outer diameter configured to enable insertion of the collar assembly into the outer shaft of the mandrel assembly. Meanwhile, an internal diameter of the flange bearing corresponds to an outer diameter of the inner shaft, suitable to enable passage of the inner shaft through the center of the flange bearing. As shown in FIG. 15, the internal diameter of the central opening of the flange bearing is smaller than the internal diameter of either of the collar end ring or the collar spacer ring.

A notch 1518 is provided into the inner face of the collar spacer ring. An aligned passage 1522 extends through each of the collar end ring and spacer ring, and opens centrally within the notch, enabling insertion of a fastener 236 (e.g., a screw, bolt, pin, etc.) through the latch mechanism 270, through the passage 1522, through an opposing end 232 of the spring 228, and engaging a reciprocal fastener 1537 (e.g., a threaded nut, etc.) Because the end 232 of the spring aligns with and is received and secured within the notch 1518, and the collar assembly is fixedly coupled with the outer shaft, the notch retains the end of the spring firmly in position relative to the collar assembly and the outer shaft.

A plug extension 1540 includes a generally cylindrical shaft portion 1542 having an outer diameter configured to enable the plug extension to telescopically insert into an end of the inner shaft. A flange 1544 formed at an opposing end of the plug extension exceeds the inner diameter of the inner shaft, preventing the entire length of the plug extension from sliding into the inner shaft.

A slot 1546 extends transversely into the cylindrical shaft portion of the plug extension. A first 'inner' portion 1548 of the slot 1546 near the end of the cylindrical shaft portion that inserts first into the inner shaft, extends completely through the diameter and exits at opposing sides of the cylindrical shaft portion 1542. A second 'outer' portion 1550 of the slot 1546 is formed at only one side of the cylindrical shaft portion, and extends only partially through the diameter of the plug extension.

During assembly, the plug extension inserts into the end of the inner shaft, and the inner portion of the slot aligns with openings provided transversely through and near the end of the inner shaft. A pin 1552 or other fastener is then inserted through the openings in the inner shaft and through the inner portion of the slot, allowing the plug extension to telescopically slide within the inner shaft along a range of motion defined by the length of the inner portion 1548 of the slot 1546. While inserted, the pin 1552 prevents the plug extension from rotating along its long axis relative to the inner shaft, and prevents the plug extension from being pulled out from the end of the inner shaft.

Further, the pin extends outwardly from opposing sides of the inner shaft. Therefore, when the end of the inner shaft is inserted through the collar assembly, the pin abuts the inner face of the flange bearing, defining a limit to how far the collar can slide onto the inner shaft. Likewise, because the end 232 of the spring is then secured to the collar spacer ring, the collar assembly is prevented from sliding off of the end of the inner shaft. Therefore, although the collar assembly is able to rotate relative to the inner shaft, the collar assembly is retained in position along the length of the inner shaft by each of the pin 1552 and the spring end 232.

The outer portion 1550 of the slot 1546, aligned linearly with the inner portion 1548 of the slot, is configured to receive insertion of the projection 272 of the latch mechanism 270 when the latch mechanism is rotated inwardly toward the inner shaft, as shown in FIG. 17. As described above, engagement of the projection with the slot prevents rotational movement of the collar assembly—and therefore the outer shaft—relative to the inner shaft. Because the outer portion of the slot extends lengthwise along the shaft of the plug extension for a length approximately equal to the length of the inner portion of the slot, the projection of the latch mechanism can engage the outer portion of the slot along the entire telescopic range of movement of the plug extension. As is shown in FIG. 15, the inner and outer portions of the slot can partially overlap, enabling a greater telescopic range of movement for the plug extension.

A passage 1556 provided transversely and fully through the plug extension adjacent to the flange 1544 is configured to receive insertion of a bolt, pin, or other fastener extending through the aligned openings 2133 of a mounting bracket (as shown in FIG. 14), and to secure the mandrel assembly to the mounting bracket via the plug extension.

In the same way as shown in FIG. 6, and with reference to FIG. 16, the collar assembly of FIGS. 15-17 is secured within and relative to the outer shaft via one or more fasteners 224 extending through opening(s) 223 in the outer shaft 202 and into corresponding receiver opening(s) 226 formed transversely into the outer, circumferential edge of the collar end ring 1514.

The above described arrangement of components can be provided at both ends of the mandrel assembly in an embodiment having two springs 228, one at each end of the mandrel assembly for example. Alternatively however, as shown in FIG. 15, the opposing end of the mandrel assembly can be configured more simply with just a collar end ring 1514', a flange bearing 1506', a pin 1552', and a plug extension 1540'. As shown in FIG. 15, the slot 1546' can be configured to extend transversely entirely through the plug extension 1540' as in the inner portion 1548 of the slot in plug extension 1540, but along the entire length of the slot 1546'. Such arrangement allows the slot 1546' to receive insertion of the pin 1552', while also allowing the plug extension to telescopically slide within the inner shaft along a range of motion defined by the length of the slot 1546'.

A securing collar 1560 slides onto the inner shaft and the inner face of the securing collar 1560 abuts the outer face of the portion of the flange bearing 1506' that directly surrounds and engages the inner shaft. A set screw 1562 (typically threaded) inwardly and adjustably transits a side of the securing collar 1560. When aligned with the mounting opening 256', the set screw 1562 further transits the mounting opening and lodges against a portion of the shaft of the plug extension 1540', securing collar in position relative to the inner shaft and securing the plug extension 1540' in position along its telescopically sliding range of motion relative to the inner shaft. The securing collar remains free from frictional contact with the collar end ring 1514' and the outer rotating cylindrical portion of the flange bearing that engages the collar end ring, and does not interfere with the free rotation of the collar end ring and the outer shaft during use.

When assembled, the mandrel assembly embodiment depicted in FIG. 15 appears as shown in FIG. 17.

Second Alternative Embodiment of the Mandrel Assembly

Figure 18:
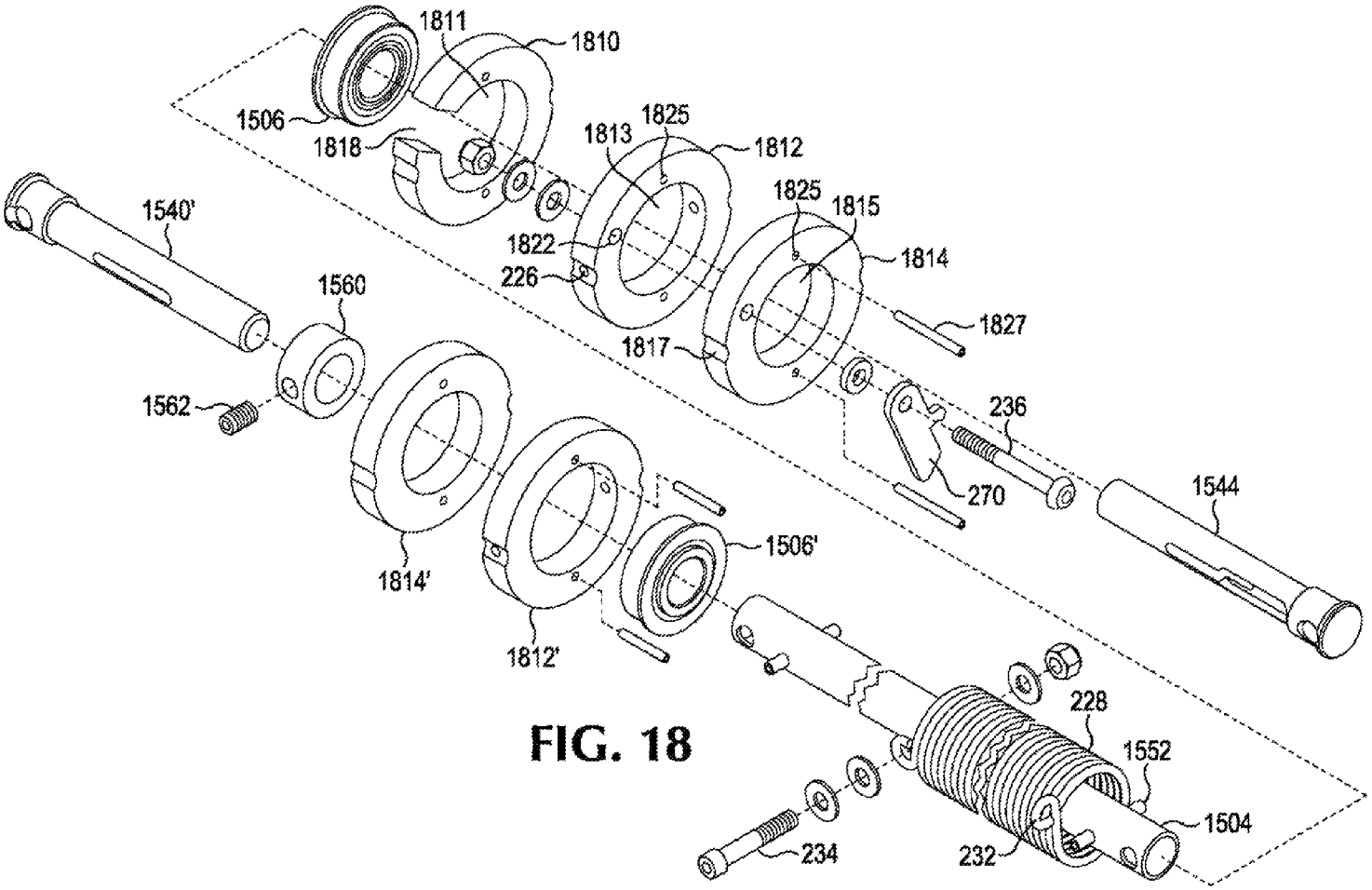
FIG. 18 is an isometric exploded view of a mandrel assembly, but omitting the outer shaft to enable viewing of components otherwise concealed from view by the outer shaft, according to another embodiment of the invention.
Figure 20:
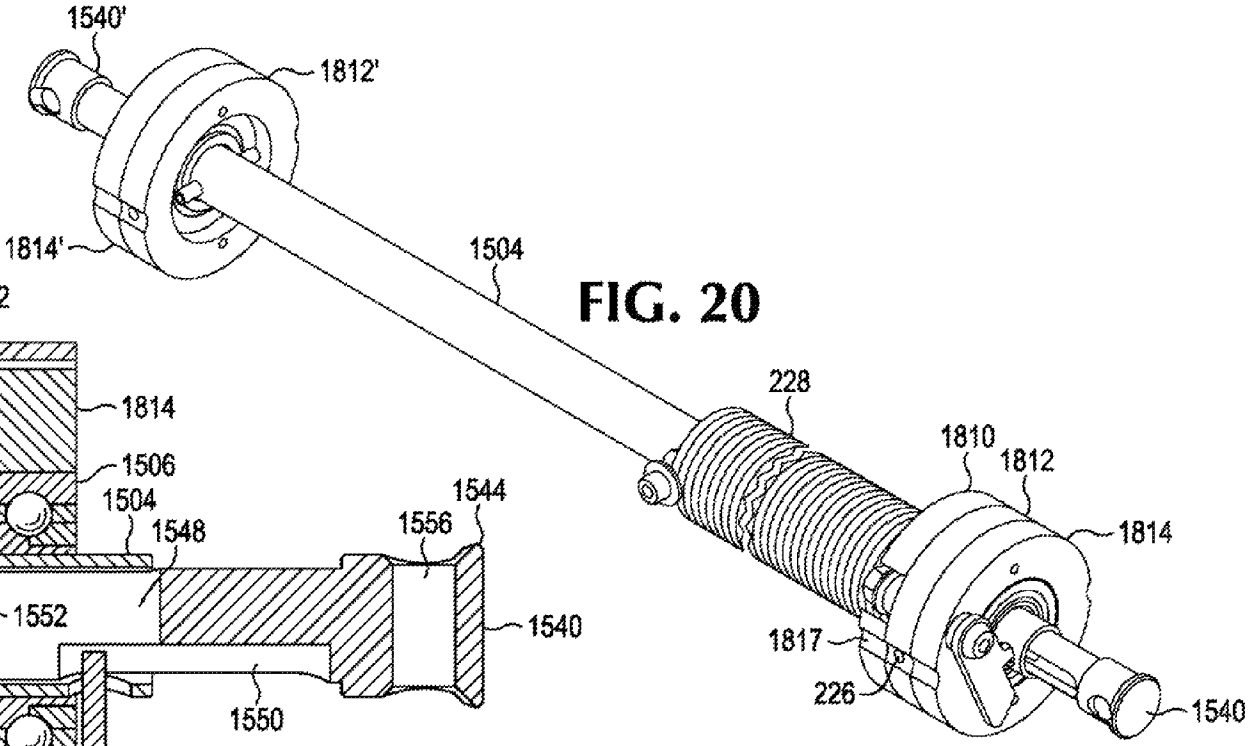
FIG. 20 is an isometric fragmentary view of the mandrel assembly for FIG. 18, but omitting the outer shaft to enable viewing of components otherwise concealed from view by the outer shaft.
Figure 19:
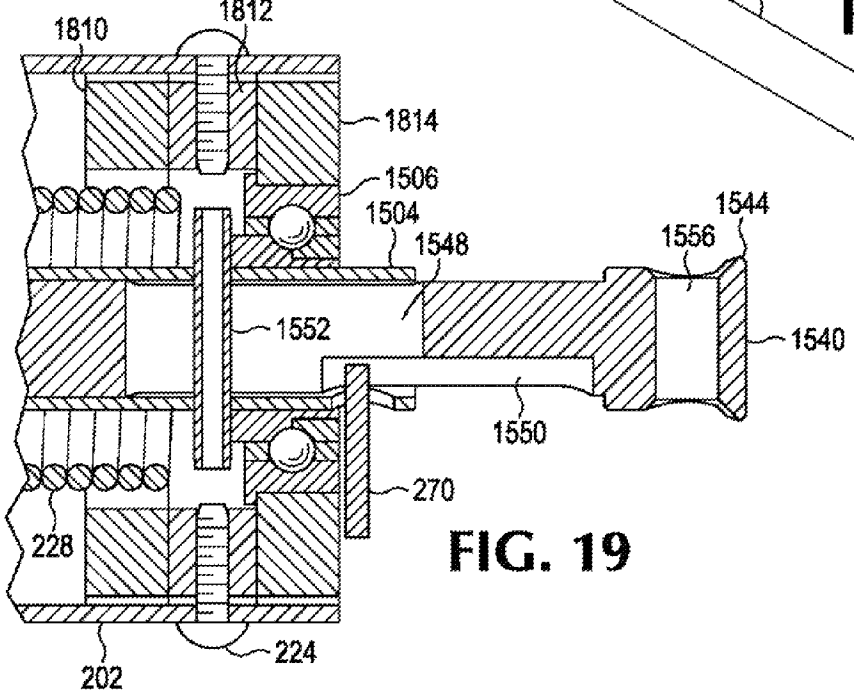
FIG. 19 is a sectional view of an end of the mandrel assembly of FIG. 18 taken along an axis corresponding to line 4-4 of FIG. 3.

FIGS. 18-20 depict the mandrel assembly according to another contemplated embodiment.

As shown, the inner shaft, plug extensions, and some other components of the embodiment shown in FIGS. 18-20 are substantially similar to those shown in the embodiment shown in FIGS. 15-17. The main differences between these two embodiments are found in the structure of the collar assembly, and the arrangement of some components (e.g., the flange bearing) relative to the collar assembly.

As shown in FIG. 18, the collar assembly includes three sequentially and coaxially arranged collar portions; a collar end ring 1814, a collar medial ring 1812, and a collar spacer ring 1810. A central opening 1815 of the collar end ring 1814 has a smaller diameter than the central openings 1813/1811 of either of the collar medial ring 1812 or the collar spacer ring 1810, respectively. In particular, as shown in detail in FIG. 19, the inner diameter of each of central openings 1813 and 1811 are larger than the outer diameter of the flange bearing 1506, and are also large enough to receive entry of an end of the spring 228. The inner diameter of central opening 1815 is large enough to receive insertion of the slightly narrower outer cylindrical portion of the flange bearing 1506, but the larger diameter flange portion of the flange bearing abuts the inner face of the collar end ring, preventing further passage of the flange bearing into the collar end ring. As shown, however, the relative outer diameters of the flange bearing outer cylindrical portion and the central opening 1815 are configured for a close fit that limits lateral dislocation of the one relative to the other during use, but nonetheless allows insertion of the former into the latter. The inner diameters of central openings 1813 and 1811 closely correlate with, but slightly exceed, the outer diameter of the flange of the flange bearing, likewise capturing and limiting lateral movement of the flange bearing during use.

Each of the collar assembly portions typically includes one or more corresponding recesses formed into their outer surfaces, such as grooves 1817. Such recesses serve several beneficial purposes. Firstly, they provide a convenient alignment indicator to aid assembly of the collar portions into a unitary collar assembly. By lining up the respective recesses during assembly, each collar assembly portion is rotationally aligned properly with each other such portion. Secondly, they provide a recessed point for welding the components together, so that a weld bead (for example) does not extend beyond the outer circumference of the collar assembly and interfere with insertion of the collar assembly into the outer shaft.

Also aiding alignment and assembly, the respective collar portions likewise include, in an embodiment, one or more openings 1825 extending fully through their thickness, from the inner face to the outer face of each collar portion. One or more slotted spring pins 1827 are inserted into and through the sequentially aligned openings 1825, connecting the collar portions together by frictional resistance, as each slightly compressed slotted spring pin asserts a retentive force against the inner walls of the aligned openings.

A fastener 236 passes throughout the latch mechanism 270 and aligned openings 1822, and secures the end of the spring 228 against the inner face of the collar medial ring 1812 via engagement with a nut and one or more washers, for example. A cutout portion 1818 of the collar spacer ring 1810 aligns with the end of the spring 228 in a manner similar to that of the notch 1518 in the collar spacer portion 1510 of the first alternative mandrel assembly embodiment, described above.

As shown in FIGS. 18-20, one or more of the collar portions each include one or more receiver openings 226 formed transversely into the outer, circumferential edge of the collar portion(s), suitable for receiving in a secure but detachable engagement one or more fasteners 224 (e.g., screws, bolts, pins, etc.) extending through a corresponding opening 223 in the outer shaft (e.g., see FIG. 19).

The above described arrangement of components can be provided at both ends of the mandrel assembly in an embodiment having two springs 228, one at each end of the mandrel assembly for example. Alternatively however, as shown in FIG. 18, the opposing end of the mandrel assembly can be configured more simply with just a collar end ring 1814', a collar medial ring 1812', and a flange bearing 1506', arranged relative to one another in substantially the same manner as the collar end ring 1814, collar medial ring 1812 and flange bearing 1506 described above. Additionally, the set screw collar 1560 and set screw 1562 engage the inner shaft 1504 and plug extension 1540' in substantially the same manner as described above and shown in FIG. 15.

When assembled, the mandrel assembly embodiment depicted in FIG. 18 appears as shown in FIG. 20.

Locking Brackets

A locking bracket 30 is typically formed from a unitary, rigid material (e.g., one-eighth inch to one-quarter inch thick sheet metal), although several configurations are contemplated according to alternative embodiments. For example, an exemplary locking bracket 1102 shown in FIG. 11 comprises a strap of formable metal, typically between approximately one inch to three inches (1"-3") wide and six inches to twelve inches (6"-12") in length. Alternatively, a locking bracket 30, 30' can be formed of a rather more complexly formed, planar, unitary piece that is bent as shown to form a three-dimensional, surface mountable structure, an embodiment of each of which is shown in FIGS. 9-10 and FIG. 23, respectively.

A generally triangular notch 1104/1104' is typically located approximately midway between the opposing ends of the locking bracket, for example, formed into one edge of the locking bracket. An angle formed by the inner edges of the notch is preferably although not exclusively obtuse, and in a variation, the respective inner walls may curve gradually outwardly as they depart from the inner apex of the notch. The inner apex 1106 of the triangular notch can be rounded or angular, but is preferably rounded, with a radius approximately matching that of a rod 15 to be engaged with the notch when the curtain 10 is deployed during use. Likewise, the intersection 1108 of the notch with the edge of the strap at either side of the notch can be either angular or rounded, but is preferably rounded.

Figure 11:
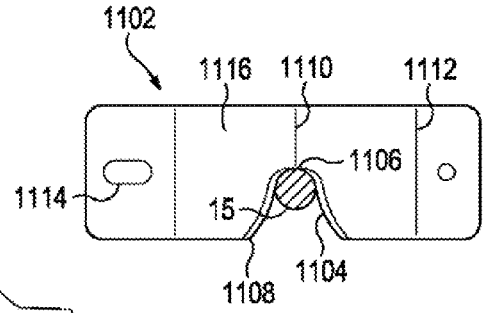
FIG. 11 is an elevation view corresponding to that of FIG. 10, depicting a locking bracket and a curtain rod section arranged and deployed for use, according to another embodiment of the invention.

In the embodiment of FIG. 11, the strap is bent centrally into an angle, at 1110, with the bend being generally aligned with the apex of the notch. The angle of the bend may be either obtuse, right, or acute, with an obtuse or right angle being preferred. Additionally, a portion of each opposing end of the strap is bent 1112 in an opposite direction from the central bend 1110, with the resulting obtuse angle being one-half (½) that of the angle of the central bend. One or more openings 1114 are formed through each end portion beyond each outermost bend, each of which allows for insertion of a fastener for attaching the bracket to a mounting surface, generally a compartment sidewall 70.

Figure 9:
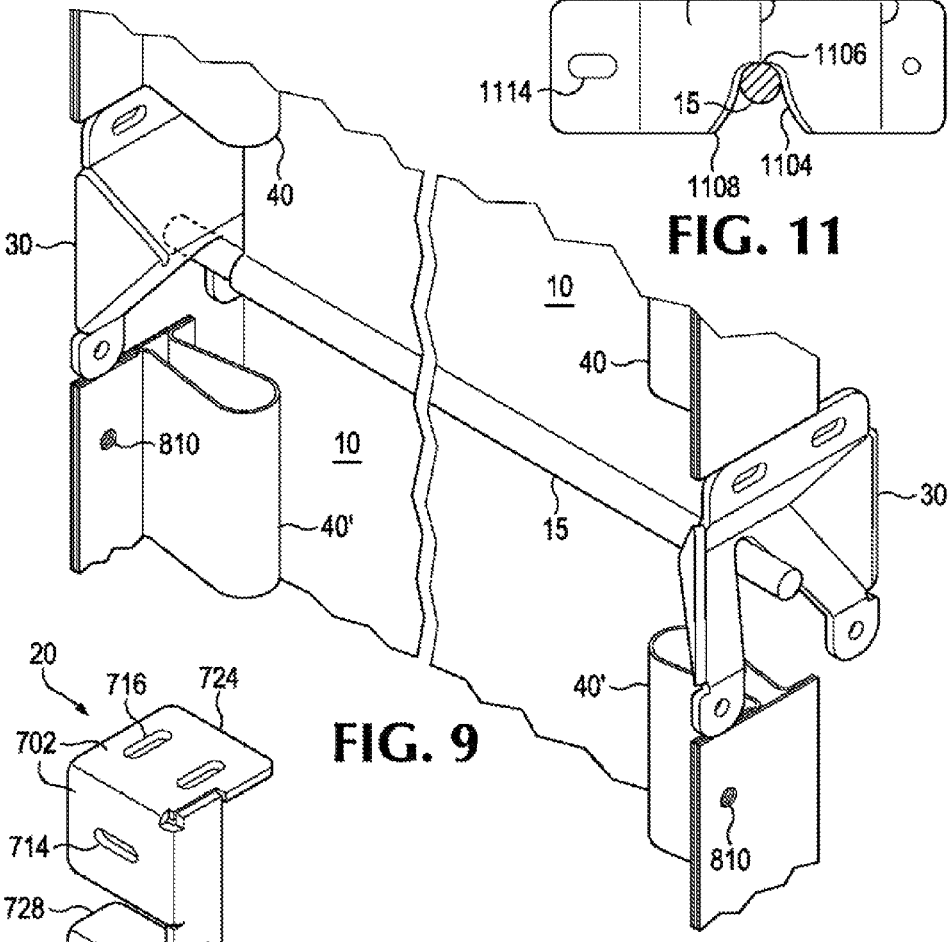
FIG. 9 is an isometric view of a locking bracket, and of portions of a side seal and a curtain, as arranged when installed and deployed for use according to an embodiment of the invention.
Figure 10:
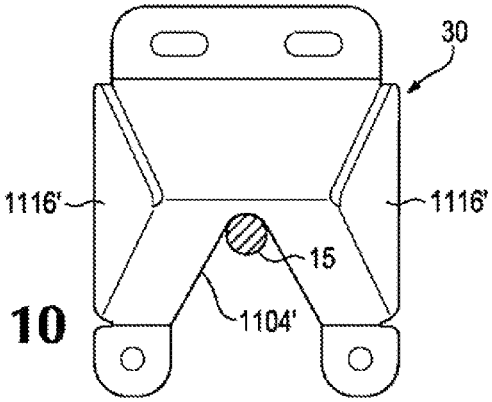
FIG. 10 is an elevation view of a locking bracket and a curtain rod section, as arranged when installed and deployed for use according to an embodiment of the invention.
Figure 23:
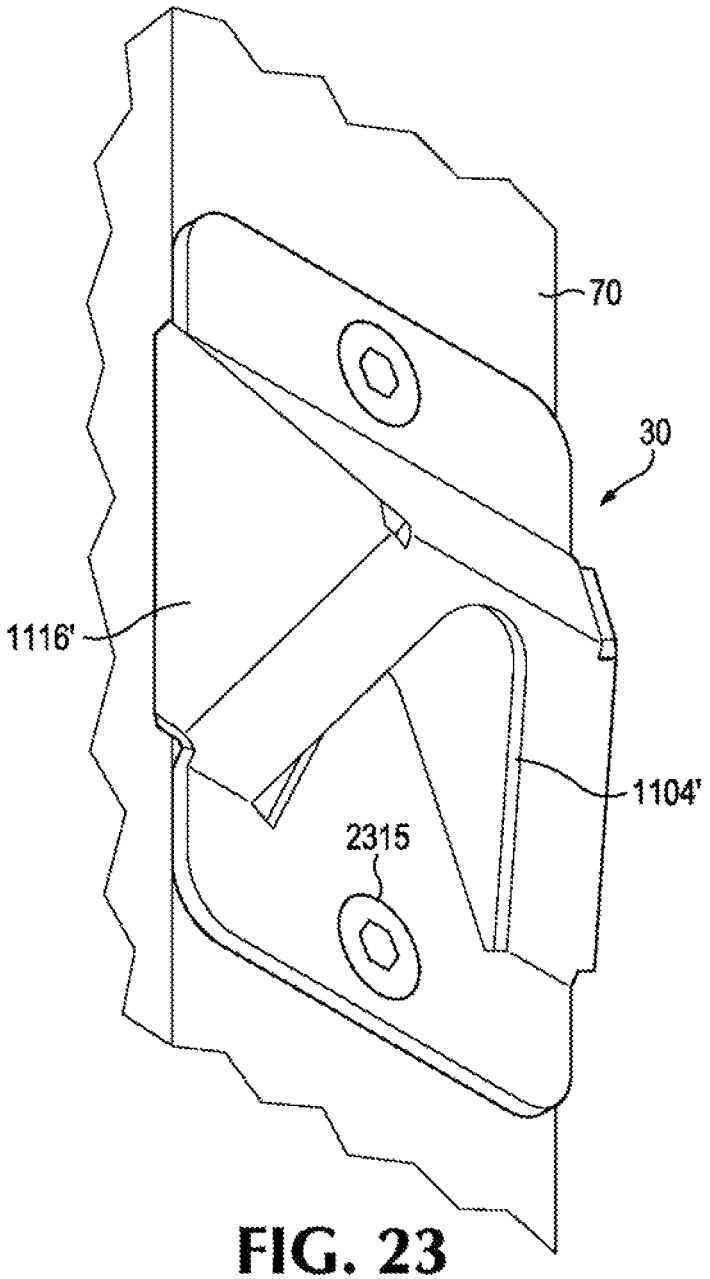
FIG. 23 is an isometric view of a mounting bracket coupled with a structural surface, according to another embodiment of the invention.

The embodiment of FIG. 23, which is a variation of the embodiment(s) shown in FIGS. 9-10, includes vertically-aligned openings for receiving fasteners 2315 so that each fastener 2315 can penetrate a side wall 70 and securely engage with a relatively narrow, vertical structural member located behind the side wall, for example.

When mounted for use, the ends of each locking bracket located beyond the outermost bend present planar 'rear' surfaces to a common mounting surface, while the central portion of the bracket extends away from the mounting surface. Angular side faces 1116/1116' of each locking bracket help to deflect impacting objects (e.g., crates, hand trucks, etc.) away from the locking bracket, reducing sheer forces and the likelihood that the mounting bracket will be dislodged from a mounting surface by incidental contact.

The notch 1104 of each locking bracket is orientated downwardly during use, to engage an end of one of the rods 15 extending along the curtain face. The curtain 10 is deployed (unrolled) downwardly until a rod end is positioned below and aligned with a notch of the locking bracket, and the curtain is then allowed to reverse direction and be pulled upward by spring tension of the mandrel until the rod end is trapped within the notch, preventing further upward movement of the curtain. Continuous upwardly oriented tension asserted on the curtain by the spring of the mandrel assembly keeps the rod firmly held within the apex of the notch. However, if the curtain or the rod is struck by a laterally applied force (e.g., by a shifting load impacting the face of the curtain), the rod can dislocate away from the applied force, traversing along an angled inner edge of the notch until the compound angle of the notch allows the rod to exit the notch. The curtain can then roll up onto the mandrel, avoiding serious damage such as puncturing of the curtain or breaking of the rod.

The locking brackets are typically installed at a height above a floor of a compartment corresponding to a position of a curtain rod when the curtain is fully deployed and closed as during use. Further, the locking brackets are preferably positioned close to the floor, so that not much of the curtain hangs freely and unrestrained laterally below the level of the locking brackets.

Alternatively, a locking bracket can be machined from a block of material to provide a downwardly facing 'V'-shaped notch, or by casting, molding (e.g., injection molding, etc.), thermoforming, or by any other process, that an ordinarily skilled artisan would recognized is suitable to provide a securely surface-mountable bracket with a downwardly facing 'V'-shaped notch corresponding to the described embodiments. Still further, a locking bracket can be formed of two or more separate components or materials securely joined together to form a structure that includes features for securely attaching the structure to a compartment side wall 70 (e.g., openings 1114), and also an inverted 'V'-shaped notch for engaging and retaining a rod or similar structure extending from a side of a curtain, as shown in the figures and equivalents thereof as would be recognized by an ordinarily skilled artisan in light of this description.

Side Seals

The side seals are part of the overall functioning thermal curtain device, but the side seals themselves are not currently considered novel parts of the invention.

Referring to FIGS. 8-9, each side seal 40 comprises a lengthwise folded-over, flexible sheet material 802 joined with a matching length of a base strip 804 of a flat, rigid or semi-rigid material. The opposing sides 806/806' of the folded flexible material can be bent in opposite directions to present a flat surface for attachment to the base strip 804, by an adhesive, for example. At an edge of the base strip, the base strip can be folded over to capture and firmly retain a portion of the flexible sheet edge. Alternatively, another strip of material 808 can be overlaid on the sheet edge, sandwiching the sheet edge against the underlying base strip 804.

Openings 810 are typically provided through and spaced out along the strip, and sometimes through the flexible sheet material as well, allowing insertion of fasteners (e.g., screws, bolts, etc.) for attaching the side seal to a vertical surface.

When installed, each of a pair of matching side seals extends along a vertical surface aligned with a track of motion of the descending curtain, and the folded over sheet material overlaps the edges of the curtain as shown in FIG. 8. When a rod of the curtain engages the apices of the corresponding locking brackets, the curtain edges are pulled into confrontation and contact with the side seals, forming a generally continuous seal against air transit past the sides of the curtains. An exception to such continuous seal is where a portion of the locking bracket extends across the path of the side seal, as shown in FIG. 9, in which case each side seal consists of two aligned pieces, one attached above the locking bracket 40 and one below 40'.

The remainder of the modular curtain device can also be installed and used without installing side seals, although unrestrained passage of air around the sides of the curtain would be expected, reducing the effectiveness of the thermal curtain device in maintaining a thermally-stable environment in a portion of a compartment.

FIG. 12 depicts a mounting bracket corresponding to the embodiment shown in FIG. 7, but as viewed from an angle that renders the structure and arrangement of the securing flange 720 more clearly visible. FIG. 13 depicts an embodiment of the invented device in which the curtain is fully deployed and engaged with the locking brackets as during use, to close off a portion of a temperature-controlled compartment. In light of the foregoing description and figures, it is expected that FIGS. 12 and 13 will be largely self-explanatory to an ordinarily skilled artisan.

In an exemplary but non-exclusive embodiment, the described collar 214 and first bushing 240 and pin 252 are provided at each of the opposing ends of the mandrel assembly. Because some embodiments include a spring 228 provided only at one end of the mandrel assembly, such embodiments generally will not include a second flange bushing 260, and may not include the fastener 236 or an opening 238 provided through the collar to receive fastener 236. However, in an embodiment that optionally includes a latch mechanism 270 at both ends of the mandrel assembly rather than at just one end, the fasteners 236 and corresponding opening 238 will generally be included at both ends of the mandrel assembly. Additionally, when an embodiment includes a latch mechanism 270 at only one end of the mandrel, the end of the inner shaft disposed at the end of the mandrel that does not include a latch mechanism may also not include a latch opening 254.

An ordinarily skilled artisan will readily recognize that various dimensions of a mandrel assembly and its associated components can be altered in embodiments while remaining fully within the scope of the invention. For example, a length of the mandrel assembly, the curtain, etc. can be configured to correspond with the internal dimensions (e.g., width, height, etc.) of any compartment within which the device is to be used. Likewise, a thickness, number of layers, or material of the curtain can be altered to provide more or less thermal isolation, such as by slowing heat conduction through the curtain. Additionally, a distance that a side seal extends away from a sidewall can be increased or decreased by use of either a 'taller' or 'shorter' fold of seal material 802 relative to the base strip 804. These are, of course, only a few of the numerous dimensional alterations that fall within the scope of the contemplated embodiments and their equivalents.

In a contemplated alternative embodiment, a locking bracket is either coupled with or integrally formed at a lower portion of a side seal (e.g., as a portion of base strip 804) to form a unitary structure. Likewise, a mounting bracket can be coupled with or integrally formed at an upper portion of the side seal to form a unitary structure. Lastly, both of a mounting bracket and a locking bracket can be coupled with or integrally formed as parts of a side seal, forming a single unitary structure. Such alternative embodiments simplify the installation process even further by reducing the number of parts that must independently be properly positioned with one another during installation, and providing consistency in the installed arrangement, and potentially providing for a more secure installation with fewer fasteners.

The invented embodiments provide numerous benefits relative to prior art devices. For example, the mounting brackets being separable from the mandrel assembly enables easier, quicker, safer, and less expensive installation. The mounting brackets can be installed into a compartment separately from the heavier mandrel assembly, obviating the need for additional workers or accessory structures (e.g., scaffold, etc.) to elevate, position and maintain the entire mandrel assembly elevated and stationary throughout installation. Instead, the mandrel can simply be lifted into position after the mounting brackets have already been securely installed. Further, the provided mandrel support ledge of the mounting bracket receives and supports the mandrel once it has been lifted into place, again obviating the need for a worker or other structure to support the mandrel throughout attachment. These are primary but not exclusive benefits of the invented embodiments.

Deployment and recovery of the curtain does not require a user to first pull the curtain downwardly at or above a particular threshold rate of speed, and then release it, unlike a well-known mode of operation for window shades and other thermal curtain devices. Instead, the structure of the latching mechanism prevents inadvertent locking and unlocking of the mandrel during use, while enabling easy and secure manual operation.

Additionally, the invented embodiments are less likely to be damaged when struck by objects than are previously existing devices, due to the self-releasing inverted 'V' configuration of the locking brackets. When the curtain is deployed during use, it will typically be retained in position by the locking brackets, not by the latch mechanism, which condition enables automatic recovery of the curtain when struck. However, if desired by the user, the curtain can alternately be retained in a deployed position by either the latch mechanism alone, or by the latch mechanism and the locking brackets. When retained by the latch mechanism alone, however, the bottom portion of the curtain may swing inwardly away from the side seals in response to being stricken by an object, likewise providing some protection from impact damage.

It will be understood that the present invention is not limited to the method or detail of construction, fabrication, material, application or use described and illustrated herein. Indeed, any suitable variation or equivalent is contemplated as an alternative embodiment, and thus is within the spirit and scope, of the invention.

It is further intended that any other embodiments of the present invention that result from any changes in application or method of use or operation, configuration, method of manufacture, shape, size, or material, which are not specified within the detailed written description or illustrations contained herein yet would be understood by one skilled in the art, are within the scope of the present invention.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

We claim:

1. A thermal curtain apparatus, comprising:

a mandrel assembly including:

an elongate inner shaft disposed coaxially within an elongate cylindrical outer shaft, wherein opposing ends of the inner shaft extend longitudinally beyond each corresponding end of the outer shaft;

a curtain comprising an expanse of a flexible generally air impermeable material coupled at a first end thereof along the outer shaft by hook and loop fastening material, wherein the curtain is configured to concentrically wrap around the outer shaft in response to rotation of the outer shaft in a first direction during use, and to unwrap from the outer shaft in response to rotation of the outer shaft in a second direction during use; and a coiled spring coupled at a first end with the inner shaft and coupled at a second end with the outer shaft, wherein rotation of the outer shaft in the second direction relative to the inner shaft loads tension in the spring;

a pair of elongate mounting brackets, wherein each mounting bracket of the pair includes:

a base plate having a planar portion and opposing upper and lower ends thereof extending perpendicularly therefrom and which are both generally offset to one side of the width of the mounting bracket, the opposing ends and the planar portion of the base plate of the mounting bracket lie in a plane perpendicular to a securing flange portion of the bracket, and wherein the planar portion of the base plate includes plural horizontally slotted openings formed fully there through, with the openings being positioned at intervals between the two opposing ends of the mounting bracket, the slotted openings generally orientated perpendicular to the long axis of the bracket, and configured to receive insertion of fasteners for coupling the mounting bracket securely to a vertical surface of a sidewall, and wherein each of the opposing ends of the base plate are facing toward one another with the facing surfaces of the opposing ends lying in a planar-parallel relationship relative to each other, and at an angle of substantially ninety degrees relative to each of the base plate and the securing flange, an edge of each opposing end welded to an adjacent edge of the securing flange, and one or more slotted openings disposed through each of the opposing ends of the mounting bracket, the openings in the upper end of the mounting bracket configured to receive insertion of fasteners for coupling the mounting bracket securely to a horizontal surface directly above the mounting bracket:

whereby a planar mandrel support ledge is provided along an inner face of the base plate, where an upper portion of the base plate is in transverse relationship to a lower portion thereof, with a slot extending across the base plate from an edge opposite the securing flange until arriving at an angled junction between the base plate and the securing flange, the ledge extending ninety degrees from the lower portion of the base plate for a distance that is less than the distance by which an end of the inner shaft of the mandrel assembly extends beyond a corresponding end of the outer shaft, and the ledge defining an inward facing tab formed between opposing ends of the mounting bracket, where the tab lies in a planar-parallel relationship with each of the opposing upper and lower ends of the mounting bracket, forming the mandrel support ledge;

a pair of locking brackets, wherein each locking bracket of the pair includes: a planar base portion configured to confront and be securely coupled with the vertical mounting surface via one or more fasteners, and an inverted-V shaped rod engaging portion configured to receive and retain one of the two opposing ends of a first elongate rod extending through the curtain to retain the curtain in an unwrapped, deployed condition in opposition to tension loaded in the spring.

2. The thermal curtain apparatus of claim 1, further comprising a pair of elongate side seals configured to extend vertically along the vertical mounting surface between a mounting bracket of the pair of mounting brackets and locking bracket of the pair of locking brackets, wherein each side seal of the pair includes:

a base portion having a planar first side for confronting and securely coupling at the vertical mounting surface via one or more fasteners; and a seal including an elongate, flexible material including opposing sides bent in opposite directions to form a flat surface of attachment to the base portion, folded over lengthwise to form a generally bulging and flexible protrusion and coupled along an opposing second side of the base portion, wherein:

the seal extends approximately perpendicularly from the base portion and the vertical surface when the side seal is coupled at the vertical surface for use, and the seal overlaps an edge of the curtain extending between the first and second ends of the curtain when the curtain is unwrapped from the outer shaft during use and whereby the curtain tends to press against the pair of elongate seals due to refrigerated air flow, tending to seal a truck compartment to conserve energy expended in refrigerating the truck compartment.

3. The thermal curtain apparatus of claim 1, wherein the coiled spring is disposed within the outer shaft, and the inner shaft extends longitudinally through the coiled spring.

4. The thermal curtain apparatus of claim 1, further comprising a pair of collar portions, wherein:

each of the collar portions of the pair are disposed within and coupled with the outer shaft to prevent rotational movement of each collar portion relative to the outer shaft;

the collar portions are disposed respectively at opposing ends of the outer shaft; and the inner shaft extends coaxially through a central opening of each collar portion.

5. The thermal curtain apparatus of claim 4, further comprising a latch mechanism pivotably coupled at an outer surface of either or both collar portions of the pair of collar portions, wherein:

a projection extends from a side of the latch mechanism proximate the inner shaft;

the projection is configured, when pivoted into a first position, to engage with a recess disposed into an outer surface of either of the inner shaft or a plug extension extending longitudinally from an end of the inner shaft, and to prevent rotation of the inner shaft relative to the outer shaft; and the projection is configured, when pivoted into a second position, to disengage from the recess and to allow rotation of the inner shaft relative to the outer shaft.

6. The thermal curtain apparatus of claim 4, further comprising either of a flange bushing or a flange bearing disposed concentrically within a recess formed at an inner surface of either or both of the collar portions, wherein the inner shaft extends through a central opening of the either of a flange bushing or a flange bearing.

7. The thermal curtain apparatus of claim 4, wherein:

each of the collar portions comprises two or more collar ring portions arranged sequentially and adjacently; and the inner shaft extends coaxially through the central openings of the two or more collar ring portions.

8. The thermal curtain apparatus of claim 1, wherein the inner shaft is cylindrical, and further comprising:

an elongate plug extension having a first end configured for insertion coaxially into an end of the inner shaft, and having a second end configured to extend beyond an end of the inner shaft, wherein a shaft portion of the plug extension extending from the first end thereof toward the second end thereof is configured suitably to slide telescopically into and out of the end of the inner shaft.

9. The thermal curtain apparatus of claim 8, wherein:

the second end of the plug extension includes an opening formed transversely therethrough;

the mandrel support portion of the mounting bracket includes an opening formed transversely therethrough; and the opening through the second end of the plug extension aligns with the opening through the mandrel support portion when the thermal curtain apparatus is installed for use, enabling a fastener to be inserted through the respective openings in the plug extension and the mandrel support portion and to securely couple the mandrel assembly with the mounting bracket.

10. The thermal curtain apparatus of claim 1, wherein the curtain further comprises one or more additional elongate rods spaced apart along and coupled with the curtain in a parallel arrangement relative to the first elongate rod.

11. The thermal curtain apparatus of claim 8, further comprising a set screw securing collar disposed about the inner shaft at an end thereof, wherein:

an adjustable set screw transversely extends through the securing collar and through an opening formed in the end of the inner shaft; and a first end of the set screw extending into the inner shaft engages the plug extension in a manner suitable to interfere with removal of the plug extension from the end of the inner shaft.

12. The thermal curtain apparatus of claim 1, wherein the generally air impermeable material is fiber reinforced vinyl.

13. The thermal curtain apparatus of claim 1, further comprising a guard bar coupled to lower ends of the mounting brackets to protect the mandrel assembly.

* * * * *